US007491249B2

(12) United States Patent
Foote et al.

(10) Patent No.: US 7,491,249 B2
(45) Date of Patent: Feb. 17, 2009

(54) FUEL ADDITIVE FORMULATION AND METHOD OF USING SAME

(75) Inventors: Arthur R. Foote, Melbourne, FL (US); Michael Lakin, Walnut Creek, CA (US); Peter Wachtel, Scotch Plains, NJ (US); Albert Schrage, West Orange, NJ (US)

(73) Assignee: Mazoil Technologies, Ltd., Grand Cayman (KY)

( * ) Notice: Subject to any disclaimer, the term of this patent is extended or adjusted under 35 U.S.C. 154(b) by 509 days.

(21) Appl. No.: 10/432,967

(22) PCT Filed: Jul. 27, 2001

(86) PCT No.: PCT/US01/23604

§ 371 (c)(1),
(2), (4) Date: May 27, 2003

(87) PCT Pub. No.: WO02/10316

PCT Pub. Date: Feb. 7, 2002

(65) Prior Publication Data

US 2004/0148849 A1 Aug. 5, 2004

Related U.S. Application Data

(63) Continuation-in-part of application No. 09/628,020, filed on Jul. 28, 2000, now Pat. No. 6,319,294.

(51) Int. Cl.
*C10M 1/22* (2006.01)

(52) U.S. Cl. ..... 44/388; 44/399; 44/400; 44/412; 44/413; 44/414

(58) Field of Classification Search ..... 44/414, 44/388

See application file for complete search history.

(56) References Cited

U.S. PATENT DOCUMENTS

| | | | | |
|---|---|---|---|---|
| 2,673,793 | A * | 3/1954 | Brodhacker | 149/90 |
| 3,900,297 | A * | 8/1975 | Michaels | 44/389 |
| 4,073,626 | A * | 2/1978 | Simmons | 44/367 |
| 4,330,304 | A * | 5/1982 | Gorman | 44/322 |
| 4,365,973 | A | 12/1982 | Irish | |
| 4,583,991 | A * | 4/1986 | Germane et al. | 44/414 |
| 5,141,524 | A * | 8/1992 | Gonzalez | 44/340 |
| 5,489,316 | A * | 2/1996 | Traverso | 44/323 |
| 5,782,937 | A * | 7/1998 | Colucci et al. | 44/324 |
| 6,319,294 | B1 * | 11/2001 | Foote et al. | 44/388 |

FOREIGN PATENT DOCUMENTS

| | | |
|---|---|---|
| EP | 0 247 706 | 12/1987 |
| EP | 0 755 996 | 1/1997 |
| GB | 535401 | 4/1941 |

* cited by examiner

*Primary Examiner*—Ellen M. McAvoy
(74) *Attorney, Agent, or Firm*—Kelley Dyre & Warren, LLP

(57) ABSTRACT

An improved fuel additive formulation, method of use, and method of producing the fuel formulation are described. The improved fuel additive of the present invention comprises a mixture of nitroparaffins (comprising nitromethane, nitroethane, and nitropropane), and a combination of modified commercially available ester oil and/or a solubilizing agent, and/or toluene. The ratio of ester oil and/or solubilizing agent and/or toluence to nitroparaffin is preferably less than 20 volume percent, with nitroparaffins comprising the balance of the additive. A method of preparing and using the additive formulation is also provided.

85 Claims, 6 Drawing Sheets

FUEL ADDITIVE FORMULATION AND METHOD OF USING SAME

CROSS-REFERENCE TO RELATED APPLICATIONS

The present application relates to, is entitled to the benefit of the earlier filing date and priority of, and is a national application filed under 35 U.S.C. § 371 of prior international patent application PCT/US01/23604 filed Jul. 27, 2001, that is a Continuation-in-Part of, relates to, and is entitled to the benefit of the earlier filing date and priority of, application Ser. No. 09/628,020 filed on Jul. 28, 2000, now U.S. Pat. No. 6,319,294, which are herein incorporated by reference as if fully set forth.

FIELD OF THE INVENTION

The present invention relates to an improved fuel additive formulation for internal combustion engines, and method of making and using the same. The fuel additive of the present invention provides an improved motor fuel, particularly for automobiles. The formulation of the present invention is useful in either gasoline- or diesel-fueled engines, and in automobiles, trucks, and various other engine applications. In a preferred embodiment, the invention is an additive formulation, and method of making and using the formulation, to reduce emissions, improve performance and environmental health and safety, and reduce the risks of toxic substances associated with motor fuels.

BACKGROUND OF THE INVENTION

For some time, various companies and persons have worked to improve the performance and reduce the adverse environmental effects of internal combustion engines. As the increased use of automobiles in the United States has offset reductions in auto emissions, legislators, regulators, the petroleum and automobile industries and various other groups have sought new ways to address air pollution from cars. As part of that effort, these groups have increasingly focused on modification of fuels and fuel additives. Perhaps the best known fuel modification relating to air pollution control is the elimination of lead, used as an antiknock compound, from gasoline.

The 1990 amendments to the Clean Air Act contain a new fuels program, including a reformulated gasoline program to reduce emissions of toxic air pollutants and emissions that cause summer ozone pollution, and an oxygenated gasoline program to reduce carbon monoxide emissions in areas where carbon monoxide is a problem in winter. Environmental agencies, such as the United States Environmental Protection Agency (EPA) and the California Air Resources Board (CARB), have promulgated various regulations compelling many fuel modification efforts. A coalition of automobile manufacturers and oil companies has extensively reviewed the technology for improving fuel formulations and produced what has been referred to as the "Auto/Oil" study. The data from the Auto/Oil study has formed the basis for some regulatory approaches, such as CARB's matrix of acceptable gasoline formulations.

With respect to the oxygenated gasoline program, the most commonly used oxygenates are ethanol, made from biomass (usually grain or corn in the United States), and methyl tertiary butyl ether (MTBE), made from methanol that is usually made from natural gas. Oxygenates such as ethanol and MTBE increase a fuel's octane rating, a measure of its tendency to resist engine knock. In addition, MTBE mixes well with gasoline and is easily transported through the existing gasoline pipeline distribution network. See, American Petroleum Institute website: Issues and Research Papers (http://www.api.org/newsroom.cgi) "*Questions About Ethanol*" and "*MTBE Questions and Answers*"; and "*Achieving Clean Air and Water: The Report of the Blue Ribbon Panel on Oxygenates in Gasoline*" which are incorporated herein by reference.

Reformulated gasoline has been blended to reduce both exhaust and evaporative air pollution, and to reduce the photochemical reactivity of the emissions that are produced. Reformulated gasoline is certified by the Administrator of the EPA and must include at least two percent (2%) oxygenate by weight (the so-called "oxygen mandate"). Ethanol and MTBE are both used in making reformulated gasoline.

Both ethanol (as well as other alcohol-based fuels) and MTBE have significant drawbacks. Ethanol-based fuel formulations have failed to deliver the desired combination of increased performance, reduced emissions, and environmental safety. They do not perform substantially better than straight-run gasoline and increase the cost of the fuel.

Adding either ethanol or MTBE to gasoline dilutes the energy content of the fuel. Ethanol has a lower energy content than MTBE, which in turn has a lower energy content man straight-run gasoline. Ethanol has only about 67% the energy content of the same volume of gasoline and it has only about 81% of the energy content of an equivalent volume of MTBE. Thus, more fuel is required to travel the same distance, resulting in higher fuel costs and lower fuel economy. In addition, the volatility of the gasoline that is added to an ethanol/gasoline blend must be further reduced in order to offset the increased volatility of the alcohol in the blend.

Ethanol has not proven cost effective, and is subject to restricted supply. Because of supply limitations, distribution problems, and its dependence on agricultural conditions, ethanol is expensive. The American Petroleum Institute reports that, in 1999, ethanol was about twice the cost of an energy equivalent amount of gasoline. The politics of agriculture also effect ethanol supply and price.

Ethanol also has a much greater affinity for water than do petroleum products. It cannot be shipped in petroleum pipelines, which invariably contain residual amounts of water. Instead, ethanol is typically transported by truck, or manufactured where gasoline is made. Ethanol is also corrosive. In addition, at higher concentrations, the engine must be modified to use an ethanol blend.

Ethanol has other drawbacks as well. Ethanol has a high vapor pressure relative to straight-run gasoline. Its high vapor pressure increases fuel evaporation at temperatures above 130° Fahrenheit, which leads to increases in volatile organic compound (VOC) emissions. EPA has concluded that VOC emissions would increase significantly with ethanol blends. See, *Reformulated Gasoline* Final Rule, 59 Fed. Reg. 7716, 7719 (1994).

Finally, although much research has focused on the health effects of ethanol as a beverage, little research has addressed ethanol's use as a fuel additive. Nor has ethanol been evaluated fully from the standpoint of its environmental fate and exposure potential.

MTBE has its share of drawbacks as well. MTBE was first added to gasoline to boost the octane rating. In line with the 1990 Clean Air Act amendments, MTBE was added in even larger amounts as an oxygenate to reduce air pollution. Unfortunately, MTBE is now showing up as a contaminant in groundwater throughout the United States as a result of releases (i.e., leaking underground gasoline storage tanks, accidental spillage, leakage in transport, automobile accidents resulting in fuel releases, etc.).

MTBE is particularly problematic as a groundwater contaminant because it is soluble in water. It is highly mobile, does not cling to soil particles, and does not decay readily. MTBE has been used as an octane enhancer for about twenty years. The environmental and health risks posed by MTBE, therefore, parallel those of gasoline. Some sources estimate that 65% of all leaking underground fuel storage tank sites involve releases of MTBE. It is estimated that MTBE may be contaminating as many as 9,000 community water supplies in 31 states. A University of California study showed that MTBE has affected at least 10,000 groundwater sites in the State of California alone. The full extent of the problem may not be known for another ten years. See, "*MTBE, to What Extent Will Past Releases Contaminate Community Water Supply Wells*?, " ENVIRONMENTAL SCIENCE AND TECHNOLOGY, at 2-9 (May 1, 2000), which is incorporated herein by reference.

EPA also has determined that MTBE is carcinogenic, at least when inhaled. Other unwelcome environmental characteristics are its foul smell and taste, even at very low concentrations (parts per billion). Because of these drawbacks, the U.S. Government is considering banning MTBE as a gasoline additive. In September 1999, the EPA recommended that MTBE use be curtailed or phased out. Several states are planning to halt or reduce MTBE use. California plans to phase it out by 2002, and Maine already has the EPA's permission to quit using MTBE if it can find other ways of meeting air quality standards. The EPA also has approved New Jersey's request to stop using MTBE in gasoline during the winter.

The environmental threat from MTBE may be even greater than that from an equivalent volume of straight-run gasoline. The constituents of gasoline considered most dangerous are the aromatic hydrocarbons: benzene, toluene, ethylbenzene, and xylene (collectively, "BTEX"). The BTEX aromatic hydrocarbons have the lowest acceptable drinking water contamination limits. Both ethanol and MTBE enhance the environmental risks posed by the BTEX compounds, apart from their own toxicity. Ethanol and MTBE act as a co-solvent for BTEX compounds in gasoline. As a result, the BTEX plume from a source of gasoline contamination containing ethanol and/or MTBE travels farther and faster than one that does not contain either oxygenate.

The BTEX aromatic compounds have relatively lower solubility in water than MTBE. BTEX compounds tend to biodegrade in situ when they leak into the soil and ground water. This provides at least some natural attenuation. Relative to the BTEX compounds, however, MTBE biodegrades at a significantly lower rate, by at least one order of magnitude, or ten times more slowly. Some sources estimate that the time required for MTBE to degrade to less than a few percent of the original contaminant level is about ten years.

Other initiatives have involved efforts to formulate a cleaner burning—reformulated —gasoline (RFG). For example, Union Oil Company of California (UNOCAL) has secured a number of U.S. patents that cover various formulations of RFG. Jessup, et al., U.S. Pat. No. 5,288,393, for Gasoline Fuel (Feb. 22, 1994); Jessup, et al., U.S. Pat. No. 5,593,567, for Gasoline Fuel (Jan. 14, 1997); Jessup, et al., U.S. Pat. No. 5,653,866, for Gasoline Fuel (Aug. 5, 1997); Jessup, et al., U.S. Pat. No. 5,837,126 for Gasoline Fuel, (Nov. 17, 1998); Jessup, et al., U.S. Pat. No. 6,030,521 for Gasoline Fuel (Feb. 29, 2000). The UNOCAL patents specify various end points in the blending of gasoline, and purport to reduce emissions of selected contaminants: Carbon monoxide (CO); Nitric oxides (NOx); Unburned Hydrocarbons (HC); and other emissions.

UNOCAL has already enforced one of its RFG patents. *Union Oil Company of California v. Atlantic Richfield*, et al., 34 F.Supp.2d 1208 (C.D. Cal. 1998); and *Union Oil Company of California v. Atlantic Richfield*, et al., 34 F.Supp.2d 1222 (C.D. Cal. 1998). The District Court judgment established a substantial royalty rate (5 ¾ cents per gallon) for UNOCAL's patented RFG formulation. This has increased substantially the cost of motor fuels in the affected markets. Although the judgment has been affirmed on appeal, *Union Oil Company of California v. Atlantic Richfield*, et al., 208 F.3d 989, 54 USPQ2d 1227 (Fed. Cir. 2000), and the Supreme Court has denied review.

Historically, margins in the refining and marketing of motor fuels tend to be narrow, typically less than cents a gallon. Alexi Barrionuevo, "*Stumped at the Pump? Look Deep into the Refinery,*" WALL STREET JOURNAL, B1 (May 26, 2000), which is incorporated herein by reference. RFG imposes added costs on refiners. These formulations increase the cost of the finished product, relative to straight-run gasoline. Memorandum from Lawrence Kumins, Specialist in Energy Policy, Resources, Science and Industry Division, Library of Congress, to Members of Congress, "*Midwest Gasoline Price Increases* (Jun. 16, 2000), which is incorporated herein by reference. UNOCAL's royalty rate of 5¾ cents per gallon imposes a substantial additional cost burden on RFG.

These various problems have impaired the efficacy or cost-effectiveness of each of these various alternatives. Alcohols have not resolved the performance and emission needs for improved motor fuels. MTBE imposes unacceptable environmental (soil and groundwater) and public health problems. *Methyl Teritary Butyl Ether* (*MTBE*), 65 Fed.Reg. 16093 (2000) (to be codified at 40 C.F.R. pt. 755) (proposed Mar. 24, 2000). Reformulated gasoline has been controversial and expensive. Accordingly, there remains a substantial and unmet need for an improved gasoline formulation that enhances (or at least does not impair) performance, while reducing emissions and the environmental and public health risks from motor fuels. The present invention satisfies those needs.

The present invention employs a unique combination of nitroparaffins and ester oil, to enhance the performance of and reduce emissions from internal combustion engines and, in particular, automobiles. Nitroparaffins have been used in prior fuel formulations, for different engine applications, without achieving the results of the present invention. For example, nitroparaffins have long been used as fuels and/or fuel additives in model engines, turbine engines, and other specialized engines. Nitromethane and nitroethane have been used by hobbyists. Nitroparaffins have also been used extensively in drag racing, and other racing applications, due to their extremely high energy content.

The use of nitroparaffins in motor fuels for automobiles, however, has several distinct disadvantages. First, some nitroparaffins are explosive and, pose substantial hazards. Second, nitroparaffins are significantly more expensive than gasoline—so expensive as to preclude their use in automotive applications. Third, nitroparaffins have generally been used in specialized engines that are very different than automotive engines. Fourth, the high energy content of nitroparaffins requires modification of the engine, and additional care in transport, storage, and handling of both the nitroparaffin and the fuel. Further, in some fuel applications, nitroparaffins have had a tendency to gel. The high cost, and extremely high energy content of nitroparaffins, has precluded their use as an automotive fuel. Moreover, the extreme volatility and danger of explosion from nitromethane taught away from its use as a motor fuel for automobiles.

Notwithstanding these drawbacks, patents have been issued for fuel formulations containing nitroparaffins. One of these, Michaels, U.S. Pat. No. 3,900,297 for Fuel for Engines (Aug. 19, 1975), describes a fuel formulation for engines comprising nitroparaffin compositions. Michaels notes that nitroparaffin formulations have a tendency to pre-ignition in reciprocating internal combustion engines. Moreover, Michaels notes that nitroparaffins are not readily miscible in hydrocarbons.

Michaels discloses and claims a formulation that is intended to increase the solubility of nitroparaffins in hydrocarbons. Michaels claims that nitroparaffins can be made soluble in gasoline by including a synthetic ester lubricating oil. Michaels specifies that any commercially available gasoline, having a boiling point between 140° to 400° F. is suitable. Michaels asserts that the inclusion of ester lubricating oil at the levels specified by Michaels "would render perfectly miscible otherwise immiscible nitroalkane/gasoline blends." Michaels '297 patent, at Col. 2, 11. 27-28.

Michaels expressly notes that one of the advantages of including ester lubricating oil in his invention is to provide upper cylinder lubrication: "[i]nclusion of ester lubricant in fuel compositions for reciprocating combustion engines has the further advantage of providing internal lubrication within the engine, thereby reducing engine wear and improving engine efficiency." Michaels, '297 patent at Col. 2, 11. 31-35. "Ester lubricants of the type suitable for use in the fuel compositions of the present [Michaels'] invention include those which have found wide use as "synthetic oil" in modern jet engines. These include the commercially available synthetic lubricating oils metting [sic] Military Specifications MIL-L-7808 and MIL-L-9236 of the ester type. Specific examples of commercially available synthetic oils suitable for use in the compositions of the present invention include Texaco SATO No. 7730 Synthetic Aircraft Turbine Oil, Monsanto Skylube No. 450 Jet 20 Engine Oil, and [Mobil] II Turbine Oil." Michaels '297 patent, at Col. 3, 11. 11-21. Michaels describes the chemical formulations of various ester oils, Michaels '297 patent, at Col. 3, 11. 11 to Col. 6, 11. 42, which discussion is incorporated herein by reference. The ester lubricating oils of the present invention include, without limitation, those described by Michaels in his '297 patent as well as any other ester oils that may be suitable to achieve the objects of the present invention.

Michaels expressly notes that: "[c]ommercially available ester oils of the above description usually contain additives to improve their performance as lubricants, which additives do not ordinarily adversely affect performance of such oils in my [Michaels'] fuel compositions. In general, for reasons of ready availability, use of ester oil in the form of commercially available synthetic ester turbine oils is preferred." Michaels '297 patent, at Col. 4, 11. 44-50. Michaels not only includes the additives normally found commercially in such ester oils, he expressly prefers them.

Among those additives typically included in commercially available ester oils are flame retardants. These flame retardants inhibit the combustion of the oil, without impairing the miscibility of the nitroparaffins, allowing the ester oil to lubricate the upper cylinder.

Michaels specifies that: "[t]he ester oil is preferably employed in minimum amount required to provide a homogeneous liquid fuel compositions [sic]. Use of less than that amount results in non-homogeneous compositions, with concomitant physical separation of liquid components into layers, and use of excess amounts of ester oil is wasteful and may result in excess carbon deposition within the engine, fouling of sparkplugs and generally unsatisfactory engine operation. No general rule can be set down fixing precise amounts of ester oil required to achieve homogeneity of the compositions, since that amount depends on variables such as the type of gasoline, nitroalkane and ester oil, as well as the proportions in which gasoline and nitroalkane are incorporated into the composition . . . As a general guide, use of ester oil in proportions of from 1 to 4 parts of ester oil to 8 parts of nitroalkane will ordinarily provide a homogeneous blend." Michaels '297 patent, at Col. 5, 11. 47 to Col. 6, 11. 2.

Michaels' only disclosure of making the additive or fuel relates to how to determine the appropriate amount of ester oil to provide a homogeneous blend: "the required amounts of ester oil are readily determined by simple experimentation of a routine nature, e.g. by first adding the nitroalkne to the gasoline in desired amount, then adding the ester oil in small portions, followed by thorough mixing after each addition, until a homogeneous blend is obtained." Michaels, '297 patent, at Col. 5, 11. 61-66. In contrast, both the process of the present invention and the product obtained by the present process, are different than Michaels.

Michaels claims that his invention improves combustion efficiency: "[t]he advantages of using the fuel of the present invention are found in lower fuel consumption due to high BTU of energy developed resulting in higher horsepower output and cleaner burning, since the added blends (of nitroalknes and their mixtures) improve combustion efficiency," Michaels '297 patent at Col. 6, 11. 29-34, in conjunction with glow plug engines. Michaels speculates that "[t]he same advantages may occur when this fuel is used in other internal combustion engines or jet engines." Michaels '297 patent, at Col. 6, 11. 34-36. Yet, Michaels provides no data to support this conjecture. Nor does Michaels identify any increase in horsepower or reduction in emissions, apart from high BTU content and higher fuel efficiency of Michaels' fuel.

Michaels claims a fuel comprising from 5 to 95% (volume) gasoline and 95 to 5% additive. Michaels' additive, in turn, comprises from 10 to 90% nitroparaffin and 90 to 10% ester lubricating oil. Michaels claims that his fuel is a homogeneous blend of additive and gasoline. He attributes his results to the ability of the ester lubricating oil to make the nitroparaffin soluble in gasoline. Michaels' components are a blend and do not react with one another. They are a simple mixture.

The present inventors are not aware that the formulation described and claimed by Michaels has ever been used as a motor fuel for automobiles. Although Michaels sold a fuel additive for automobiles, the present inventors believe that the additive Michaels sold may have been different than the additive disclosed in Michaels' '297 patent.

Michaels' fuel comprises 0.5 to 81.5 volume percent nitroalkane. At levels this high, Michaels' formulation teaches strongly away from automotive applications. The energy content of the nitroalkanes is simply too high for automotive use. Michaels himself provided examples of only model engines, turbine, jet engine, and other specialized applications. Nor would Michaels have been understood by persons of ordinary skill in the art as suggesting a viable automotive fuel. High nitroalkane levels would likely damage or destroy an automotive engine.

The cost of Michaels' additive is substantially higher than the cost of gasoline. At a concentration of even 5 volume percent, the cost of the finished formulation blended according to Michaels' teachings would be multiples, if not orders of magnitude, higher than the cost of an equivalent volume of gasoline. At higher concentrations, which Michaels teaches may range up to 95 volume percent, the cost is prohibitive. Michaels' fuel is not cost-effective for motor vehicle use.

Prior to 1985, a similar composition was marketed by an individual named Moshe Tal, through a corporation named TK-7. Mr. Tal sold the formulation as "ULX-15." From 1985 to March of 1987, Tal supplied a formulation that reportedly was made in accordance with the '297 patent, to a company trading under the name Energex. Energex actively marketed the product throughout the western United States by advertising it in "outdoor" magazines such as FIELD AND STREAM. Energex principals attended various events, such as fishing competitions, where on at least one occasion they demonstrated the Energex/TK-7 product for use in fishing boat engines. The Energex/TK-7 formulation enjoyed limited sales only in a narrow, non-automotive market. Michaels later asserted that the Energex/TK-7 formulation was covered by his '297 patent.

The present inventors believe that the Energex/TK-7 formulation comprised the following composition:

TABLE 1

| "Energex/TK-7" Formulation | |
|---|---|
| Component | Volume of Formulation (Parts of Total) |
| 2-nitropropane | 35-38 |
| Nitroethane | 3-4 |
| Nitromethane | 1-2 |
| Mobil Jet II ™ | ½-1 |
| Alcohol (methanol or isopropyl) | 1-2 |
| Total: | 40½-47 |

In 1986, an individual identifying himself as Michaels contacted Energex, and claimed that Energex's additive infringed Michaels' '297 patent. A principal of Energex, Don Young, met with Michaels in New York in 1986. Young observed some portions of Michaels' preparation of the '297 additive. Although no mixing process is disclosed in the '297 patent, Young understood that the preparation of the '297 composition involved a specific mixing procedure. Energex and Michaels entered into an agreement whereby Energex continued to sell the formulation.

The present inventors believe that the Energex/TK-7 additive was sold for both gasoline and diesel-fueled outboard motor engines. One or two gallons of diesel fuel was added to the diesel formulation. The present inventors are unaware of any performance testing of the Michaels formulation from this time period (prior to March 1987). In 1987, Energex ran out of money, declared bankruptcy, and stopped selling. The TK-7 product was not marketed from March of 1987 until about May of 1988.

In May of 1988, Young began selling the product in a slightly modified form, under the name "PbFree." PbFree secured product from W. R. Grace, under Michaels' supervision. PbFree sold the formulation as "TGS." The TGS formulation of the additive as sold by PbFree was substantially the same as the Energex/TK-7 formulation:

TABLE 2

| PbFree "TGS" Formulation (1988 to 1990) | |
|---|---|
| Component | Volume of Formulation (Parts of Total) |
| 2-nitropropane | 35-38 |
| Nitroethane | 3-4 |
| Nitromethane | 1-2 |
| Mobil Jet II ™ | ½-1 |
| Alcohol (methanol or isopropyl) | 1-2 |
| Total: | 40½-47 |

Although the present inventors are aware of no performance data available for the Energex/TK-7 formulation that was apparently sold from prior to 1985 through 1987, performance testing was conducted on the PbFree TGS formulation between 1989 and 1990.

As a general proposition, motor fuel testing is subject to a high degree of variability, requiring precisely defined test parameters and controls. Gasoline is extremely variable in composition. Control of the fuel is essential to securing statistically significant results from engine performance testing. Annual Book of ASTM Standards 2000, *Section Five: Petroleum Products, Lubricants, and Fossil Fuels*, Volume 05.04, Petroleum Products and Lubricants (V): D 5966—latest; American National Standards Institute (ANSI), "*Automotive Fuels—Diesel—Requirements and Test Methods*", Publication No. SS-EN 590, and "*Automotive Fuels—Unleaded petrol—Requirements and Test Methods,*" Publication No. SS-EN 228; Society of Automotive Engineers (SAE), "*Automotive Gasolines,*" Publication No. J312199807 (July 1998), which are incorporated herein by reference.

Different runs of the same formulation under comparable conditions may vary by as much as 5-17%, depending on the emission variable being measured. Variability is also inherent in the data collected in performance testing. Vehicles differ and even the same vehicle varies in performance from day to day. The variability between "nominally identical cars" can be from approximately 10 to 27 percent of the mean value, for a repeated number of tests using the same fuel in a number of similar vehicles. *The Effects of Aromatics, MTBE, Olefins and $T_{90}$ on Mass Exhaust Emissions from Current and Older Vehicles—The Auto/Oil Quality Improvement Research Program*. Society of Automobile Engineers (SAE) Technical Paper Series 912322, International Fuels and Lubricants Meeting and Exposition, Toronto, Canada (Oct. 7-10, 1991), which is incorporated herein by reference. In repeated testing of the same vehicles using the same fuel, results may vary from approximately 5 to 17% of the mean value (SAE, 1991). Atmospheric conditions, such as humidity, may also introduce variability. (SAE, 1991).

The testing of the TGS product between 1989 and 1990 did not satisfy even these generally accepted requirements for reliability in engine performance testing. Accordingly, the variability of the TGS test data is expected to be even higher than 5-17%.

Prelimiary testing of the TGS product was conducted by the University of Nebraska and Cleveland State University in 1989 and 1990. Both were small "pilot" studies. Both researchers recommended more aggressive tests to validate the initial results. The present inventors believe that such definitive testing was never conducted.

Professor Ronald Haybron of the Department of Physics of the Cleveland State University conducted a preliminary evaluation of the TGS product in 1989. He tested one vehicle and used regular (87 octane) unleaded pump gasoline, rather than a standard fuel formulation, as required by generally accepted testing standards. Nor were data measured at the same points (for example, at the same engine speeds). These limitations of procedure, small sample size, and lack of adequate control preclude any reliable conclusions being drawn from the Cleveland State study.

The Cleveland State study tested the additive at a concentration of 0.1 oz. of additive per gallon of fuel. This is a concentration of additive well below the levels specified and claimed in Michaels' '297 patent. Michaels discloses an additive concentration of 5 to 95% (6.25 oz. to 121.6 oz. per gallon) or more. The Cleveland State test was run outside that range. Although the results were not statistically significant, Prof. Haybron claimed an improvement in horsepower of 8 to 20%, and reduced carbon monoxide output of 8 to 10%, well within the variability of even a well-controlled study.

Professor Peter Jenkins, of the University of Nebraska, failed to replicate these results. The University of Nebraska, Mechanical Engineering Department conducted testing on the "TGS Fuel Additive." The Nebraska testing evaluated the data at the same engine speeds for each concentration of additive. However, pump gas (regular 87 octane) was also used instead of a controlled, reference fuel. Only two vehicles were tested. Although some evaluations showed improvement at higher concentrations of additive (i.e., at 0.5 oz. per gallon), they showed little, if any, difference at the lowest concentrations tested (0.1 oz. per gallon). Although Prof. Jenkins claimed that the testing showed a 10 to 14% improvement in fuel consumption, those values are well within the variability of even a well-controlled study. There was little to no improvement on other parameters.

In 1990, PbFree modified the formulation but continued selling the additive having the composition identified in Table 3:

TABLE 3

| PbFree Formulation (1990 to 1998) | |
|---|---|
| Component | Volume of Formulation (Parts of Total) |
| 2-nitropropane | 28 |
| Nitroethane | 11-15 |
| Nitromethane | 6-15 |
| Mobil Jet II ™ | 1 |
| Total: | 46-59 |

The present inventors believe that PbFree attempted to sell the product to leaseway Trucking Company and the Cummins Engines Corporation during 1991. At that time, the formulation was supplied by W. R. Grace under Michaels' supervision.

The present inventors believe that PbFree supplied the product to the Brigham Young University (BYU), School of Engineering for testing. The product was provided by Michaels. The present inventors understand that the PbFree composition failed to improve performance or reduce emissions in the BYU tests.

In 1992, Michaels stopped supplying product to PbFree. Young attempted to replicate Michaels' formulation from publicly available sources, such as Michaels '297 patent. Young was unable to replicate Michaels' formulation from the '297 patent alone, yet, based upon Young's observation of Michaels preparing his additive in 1986, Young determined that a special mixing step was necessary. Young experimented with various methods—stirring, rolling the components in a closed barrel, and "thermoaeration"—and was able to offer an additive formulation for sale. None of these mixing procedures are disclosed in Michaels' '297 patent.

Young continued making and selling the formulation identified above as the "PbFree" formulation, until 1998, at which point PbFree ceased operations. The present inventors are aware of no testing regarding the performance of the PbFree formulation during this period. In 1998, Young began selling the additive under the name Envirochem, LLC ("Envirochem"). The Envirochem "EChem" formulation is identified in Table 4:

TABLE 4

| Envirochem "EChem" Formulation (1998 to 1999) | |
|---|---|
| Component | Volume of Formulation (Parts of Total) |
| Nitropropane (1 or 2) | 29 |
| Nitroethane | 10 |
| Nitromethane | 10 |
| Toluene | 5 |
| Mobil Jet II ™ | 1 |
| Total: | 55 |

In addition to the prior formulations derived from Michaels (namely, the ULX-15, TGS, PbFree, and EChem formulation discussed above), other inventors have disclosed and claimed additives comprising nitroparaffins and either toluene and/or ester oil. Many of these prior known formulations, however, were either for use as a model engine fuel or lubricant. See e.g., Brodhacker, U.S. Pat. No. 2,673,793 for Model Engine Fuel (Mar. 30, 1954); Hartley, U.S. Pat. No. 5,880,075 for Synthetic Biodegradable Lubricants and Functional Fluids (Mar. 9, 1999); and Tiffany, U.S. Pat. No. 5,942,474 for Two-Cycle Ester Based Synthetic Lubricating Oil (Aug. 24, 1999). Two patents of which the present inventors are aware disclose the use of a nitroparaffin and ester oil/toluene formulation for use as a fuel additive: Gorman, U.S. Pat. No. 4,330,304 for Fuel Additive (May 18, 1982); and Simmons, U.S. Pat. No. 4,073,626 for Hydrocarbon Fuel Additive and Process of Improving Hydrocarbon Fuel Combustion (Feb. 14, 1978).

Gorman discloses a mixture of nitroparaffins, including: nitropropane, nitroethane, nitromethane, and others, at 3-65 weight percent of the additive. Gorman also discloses formulations in which toluene is present at a concentration of 74 weight percent, well in excess of the present invention, along with propylene oxide, tert-butyl hydroperoxide, nitropropanes 1 and 2, and acetic anhydride. Gorman, '304 Patent, Col. 9, 11. 53.

Simmons discloses a mixture of one part iron salts of aromatic nitro acid, 10 to 100 parts nitroparaffin, and a solvent, which may be toluene. Simmons does not disclose the use of ester oil. In some of Simmons' examples, the salt is added directly to the fuel with no solvent. In at least two of Simmons' examples, the solvent comprises about a quarter of the fuel blend, well in excess of the concentrations of toluene and/or ester oil in the present invention.

Neither Gorman nor Simmons, nor any of the other known prior formulations, disclose the ranges of nitroparaffins, and ester oil and/or toluene of the present invention, let alone the unique benefits of the present invention to reduce emissions.

Prior known formulations were made by a different process than the present invention. Many of the prior known formulations are used at higher concentrations in the fuel than is the present invention. The present invention, however, reduces emissions at lower concentrations of additive. In addition, the present invention may be used with a variety of fuels, including: gasoline, gasoline and MTBE, gasoline and ethanol, and gasoline/ethanol/MTBE formulations.

In January 2000, Envirochem's assets were purchased by First Stanford Envirochem, Inc., trading as Magnum Environmental Technologies, Inc., the assignee of the present application. The present inventors have made a diligent effort to study and improve upon the prior known formulations. As a result of these efforts, the present applicants have invented a new formulation, and method of producing and using the same.

The present inventors began by investigating the EChem formulation. A study conducted by Emission Testing Service (ETS) in January 2000 found that, although the EChem formulation performed comparable to or slightly worse than both a standard unleaded gasoline and standard gasoline plus 11% MTBE, it reduced carbon monoxide emissions relative to gasoline, reduced NOx emissions relative to gasoline plus MTBE, and improved fuel efficiency relative to both.

The present invention differs in significant respects from the prior known formulations, as well as from alcohol-based (ethanol) and MTBE fuel additives, and performs better than prior known formulations. One embodiment of the present invention is disclosed in Table 5:

TABLE 5

"MAZ 100" Formulation

| Component | Volume of Formulation (Parts of Total) |
|---|---|
| 1-nitropropane | 29 |
| Nitroethane | 10 |
| Nitromethane | 10 |
| Toluene | 5 |
| Modified Ester Oil Lubricant | 1 |
| Total: | 55 |

The present inventors have made a number of specific changes in the formulation and in the method of preparing the composition of the present invention. The present inventors believe that these changes produce the improvements they have observed.

Although prior formulations used 2-nitropropane, or a combination of 1-nitropropane and 2, the present inventors preferably remove 2-nitropropane from the formulation. 2-nitropropane is a known carcinogen. Its removal improves the material handling safety of the product.

Unlike the prior known formulations, which employed commercially available ester oils, the present inventors preferably modify the ester oil to remove, or not to introduce, tricresyl phosphate. Tricresyl phosphate is a known neurotoxin. In addition, tricresyl phosphate has flame retardant properties. The present inventors believe that this modification allows improved performance of the invention in terms of reduced emissions, at lower concentrations of additive, particularly on cold start up. It also makes the product safer to handle.

The present inventors preferably add toluene to the formulation. The inventors believe that toluene may emulsify the nitroparaffins into, or make the nitroparaffins more soluble in, gasoline and lower emissions.

The present inventors preferably lower the amount of ester oil to levels below most of the known prior additives. This too has been found to lower emissions.

The present inventors preferably lower the concentration of nitromethane. Nitromethane is also a known neurotoxin. Reduction of nitromethane reduces toxicity and lowers emissions.

The present invention is preferably employed at a lower overall concentration in the fuel relative to most prior known formulations. This too lowers emissions and reduces toxicity.

The present invention improves performance, reduces material handling requirements, and lowers environmental and public health and safety risks, as well as emissions, at concentrations at which prior formulations were either untested, ineffective, or failed to produce the unique combination of benefits of the present invention.

It has not been reliably established that the prior known formulations provided any improvement in performance or emissions. The present invention, on the other hand, achieves benefits, at low concentrations of additive. Thus, the present invention meets the long-felt, yet unresolved, need for an environmentally safe, improved fuel additive. None of the prior formulations of which the present inventors are aware reduce emissions, particularly on cold start-up. None of the prior known formulations suggest the present invention.

OBJECTS OF THE INVENTION

It is an object of the present invention to provide a motor fuel additive that provides improved performance at additive concentrations typical of known additives, and reduced emissions at lower concentrations, while avoiding many of the problems associated with prior known additives and motor fuels.

Another object of the present invention is to provide a motor fuel that exhibits improved performance relative to prior known motor fuels, while avoiding many of the problems associated with prior known motor fuels.

A further object of the present invention is to provide a motor fuel that reduces emissions relative to prior known motor fuels, while avoiding many of the problems associated with prior known motor fuels.

Yet another object of the present invention is to provide a replacement, or supplement, for oxygenates, such as ethanol and MTBE.

Another object of the present invention is to provide a replacement, or supplement, for oxygenates, such as ethanol and MTBE, that reduces emissions.

A further object of the present invention is to reduce emissions on cold start-up.

An additional object of the present invention is to provide an improved fuel formulation that reduces total hydrocarbon emissions.

Yet another object of the present invention is to provide an improved formulation that reduces non-methane hydrocarbon emissions.

Another object of the present invention is to provide an improved fuel formulation that reduces carbon monoxide emissions.

A further object of the present invention is to provide an improved fuel formulation that reduces $NO_x$ formation.

An additional object of the present invention is to provide an improved fuel formulation that reduces ozone formation.

Yet another object of the present invention is to reduce the formation of precursors to ozone formation.

Another object of the present invention is to reduce hydrocarbon emissions on cold start up.

A further object of the present invention is to reduce carbon monoxide emissions on cold start up.

An additional object of the present invention is to reduce NOx emissions on cold start up.

Yet another object of the present invention is to reduce ozone formation on cold start up.

Additional objects and advantages of the invention are set forth, in part, in the description which follows and, in part, will be obvious from the description or may be learned by practice of the invention. The objects and advantages of the invention will be realized in detail by means of the instrumentalities and combinations particularly pointed out in the appended claims.

BRIEF SUMMARY OF THE INVENTION

Figure 1:
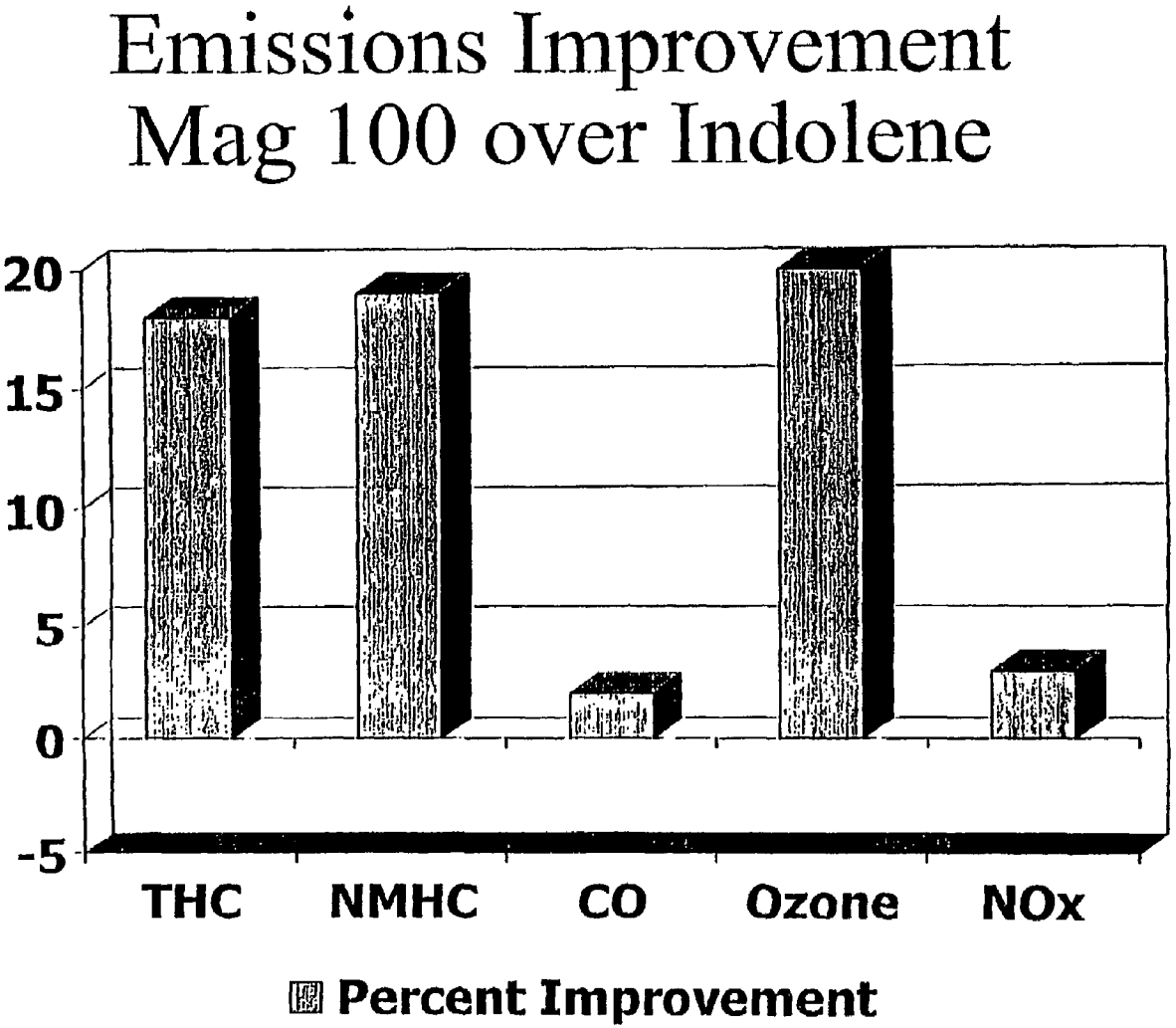
FIG. 1 is a graph depicting the percent improvement in emissions of a fuel comprising the additive of the present invention (MAZ 100) relative to Indolene, a standard reference fuel.
Figure 2:
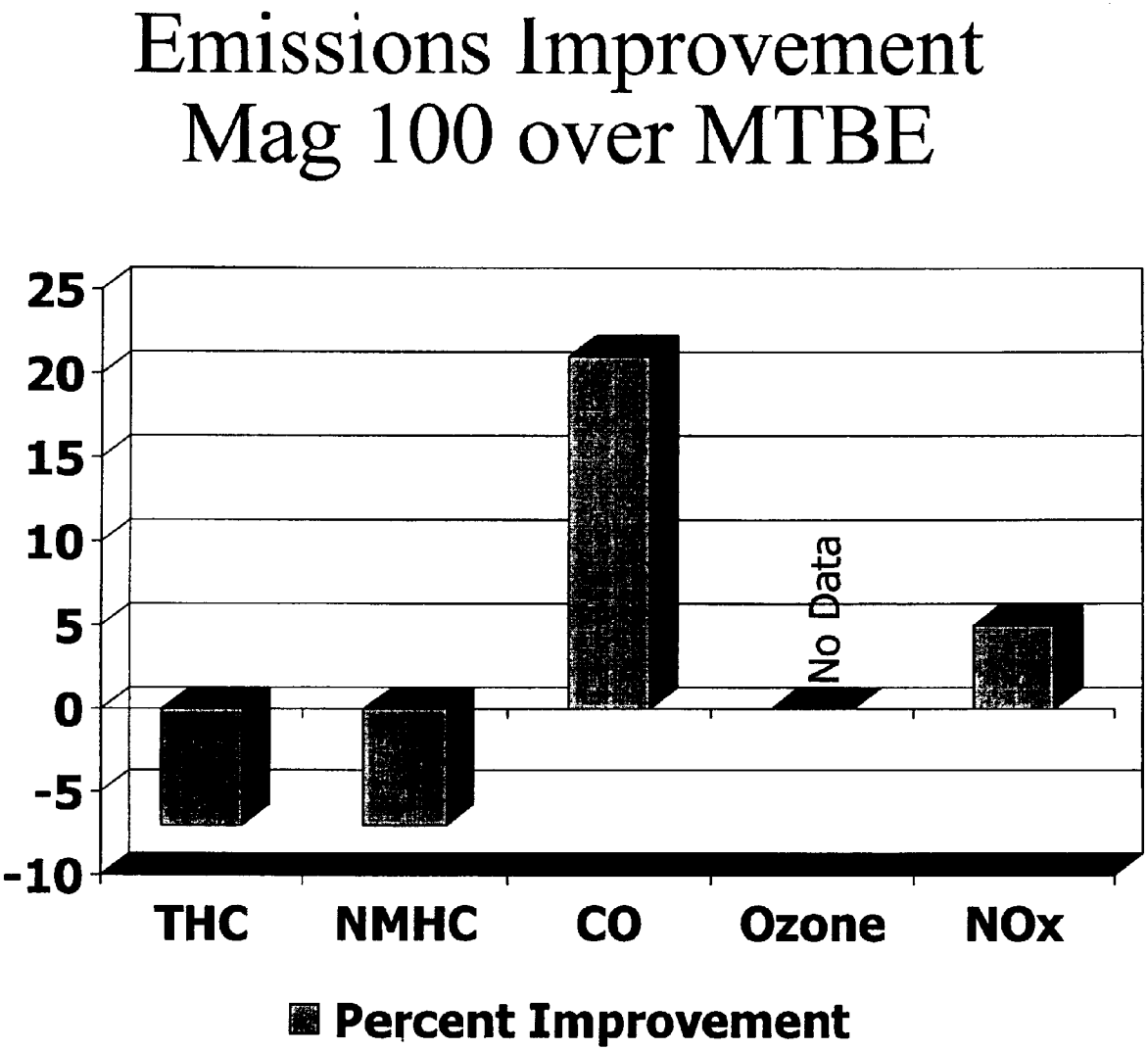
FIG. 2 is a graph depicting the percent improvement in emissions of a fuel comprising the additive of the present invention (MAZ 100) relative to MTBE.
Figure 3:
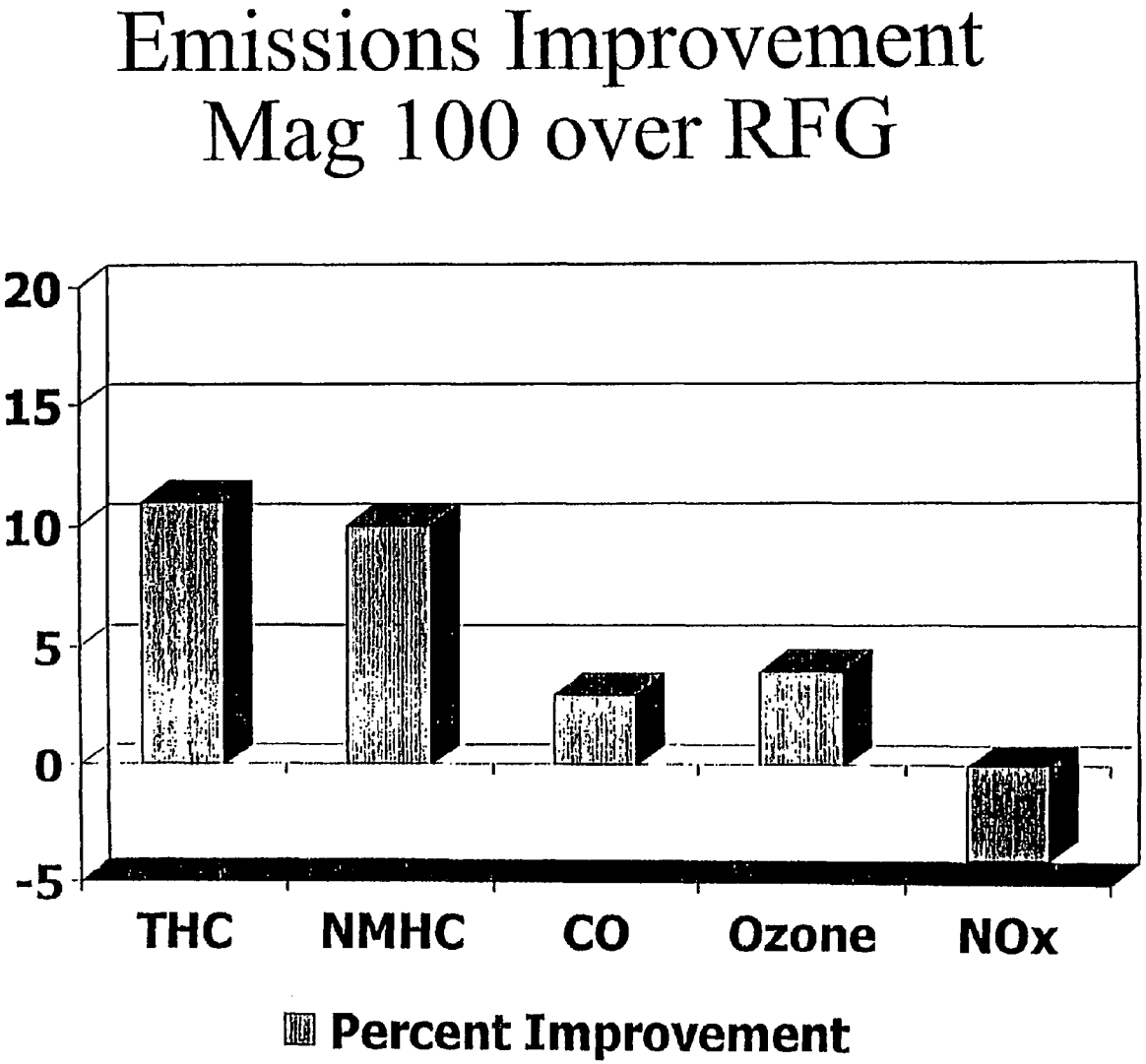
FIG. 3 is a graph depicting the percent improvement in emissions of a fuel comprising the additive of the present invention (MAZ 100) relative to RFG.
Figure 4:
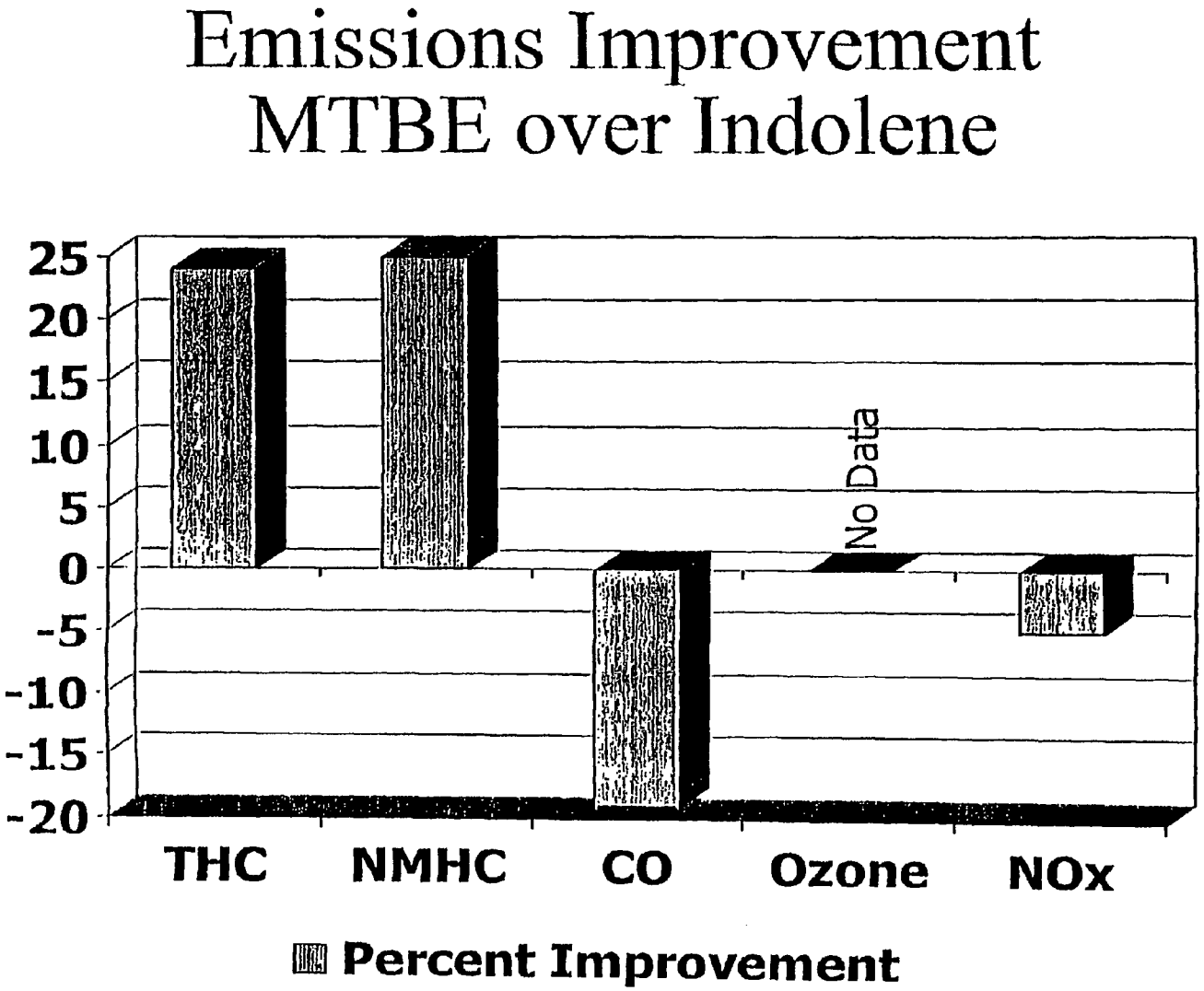
FIG. 4 is a graph depicting the prior art, namely, the percent improvement in emissions of a fuel comprising MTBE over Indolene, a standard reference fuel.
Figure 5:
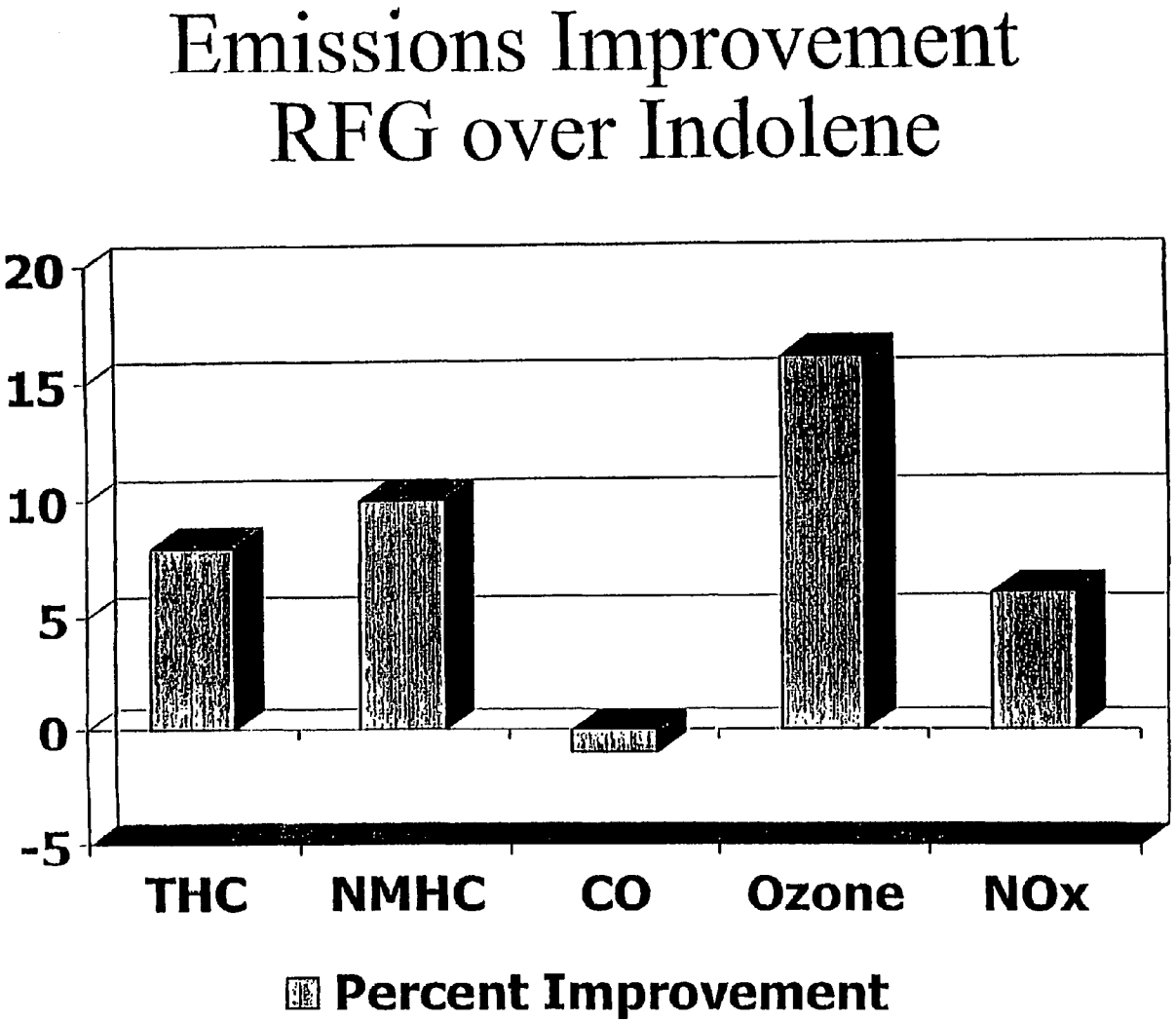
FIG. 5 is a graph depicting the prior art, namely, the percent improvement in emissions of RGF relative to Indolene, a standard reference fuel.
Figure 6:
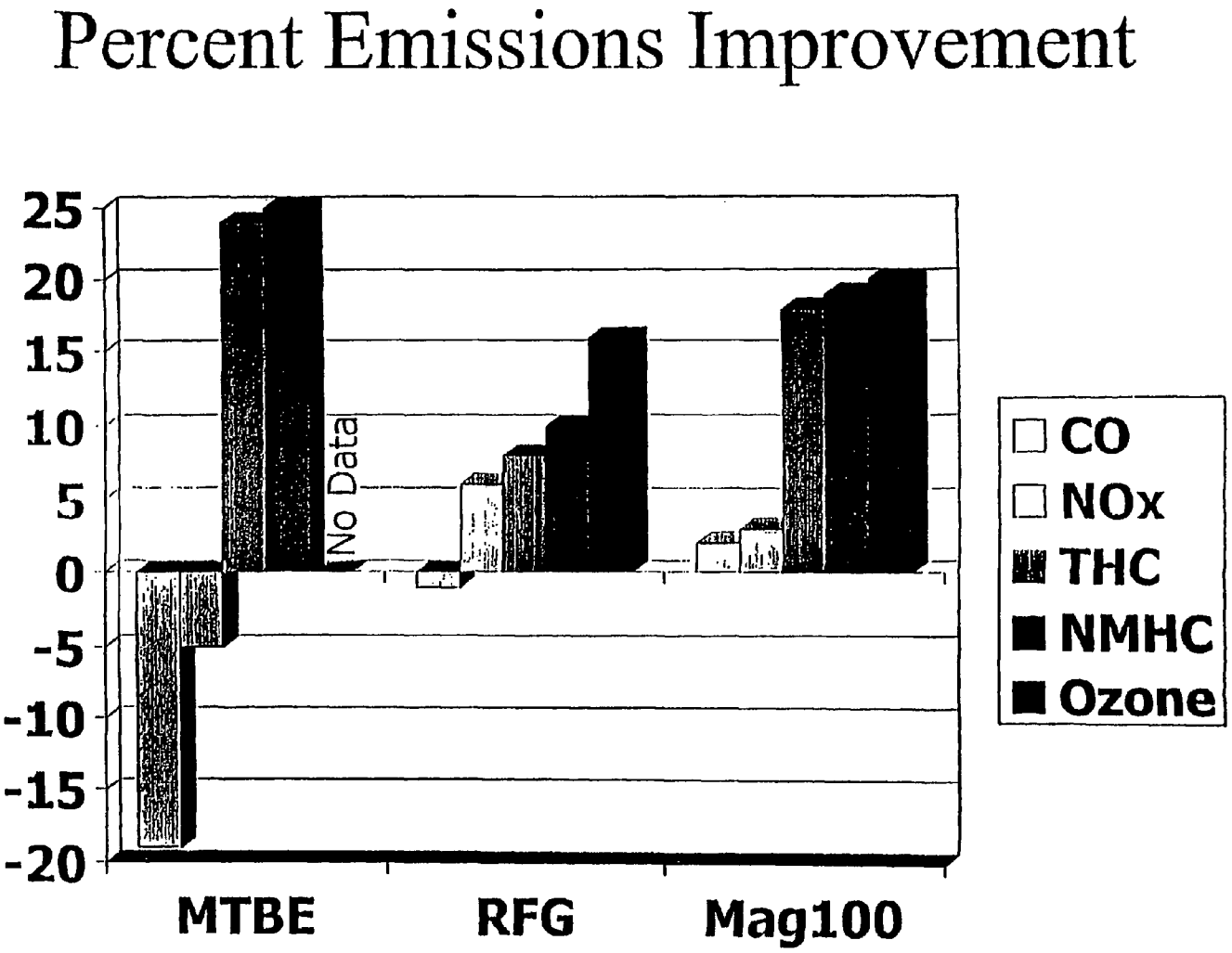
FIG. 6 is a graph depicting the percent improvement in emissions of fuels comprising the present invention (MAZ 100), and MTBE and RFG of the prior art, each relative to Indolene, a standard reference fuel.

The present invention comprises an improved fuel additive formulation and method of making and using the same. As embodied herein, the present invention comprises: an additive formulation for fuels, and a fuel containing the additive, comprising: nitroparaffin; and ester oil and/or a solubilizing agent and/or aromatic hydrocarbon; said fuel resulting in reduced emissions relative to a fuel not containing said additive when burned in a boiler, a turbine, or an internal combustion engine.

In another embodiment, the present invention comprises: an additive formulation for fuels, or a fuel containing the additive, comprising: a first component, comprising 0 to 99 volume percent nitroparaffin, selected from the group consisting of: 1-nitropropane, 2-nitropropane, nitroethane, and nitromethane; a second component, substantially comprising the balance of the additive formulation, selected from the group consisting of: ester oil lubricant, and/or a solubilizing agent with at least one chemically relatively polar end and at least one chemically relatively non-polar end, and an aromatic hydrocarbon; the additive formulation reducing emissions of one or more of the emissions selected from the group comprising: total hydrocarbons, non-methane hydrocarbons, carbon monoxide, $NO_x$, and ozone precursors. The aromatic hydrocarbon may include, but is not limited to, an alaphatic derivative of benzene, benzene, xylene, or toluene.

In a further embodiment, the present invention comprises: an additive formulation for motor fuels, and a fuel containing the additive, comprising: from about 10 to about 30 volume percent nitromethane; from about 10 to about 30 volume percent nitroethane; from about 40 to about 60 volume percent 1-nitropropane; from about 2 to about 8 volume percent toluene; and from about 1 to about 3 volume percent modified ester oil, or a solubilizing agent.

In yet another embodiment, the present invention comprises: a method of preparing a fuel additive formulation, comprising: in a mixing vessel adding about 1 part modified ester oil that is substantially tricresyl phosphate-free or a solubilizing agent; adding about 5 parts toluene; allowing said ester oil or said solubilizing agent and said toluene to stand for about 10 minutes at ambient temperature and pressure; adding about 10 parts of nitromethane to said ester oil or said solubilizing agent and toluene mixture; adding about 10 parts of nitroethane to said mixture; adding about 29 parts 1-nitropropane to said mixture; and aerating said mixture gently, through a narrow gauge tube at low pressure, and ambient temperature. As embodied herein, the invention also comprises an additive made by the method of the present invention. The invention further comprises a fuel comprising an additive made by the method of the present invention, as well as the use of the additive and fuel products as a fuel.

The fuel may be used in any kind of power unit, including, but not limited to, a boiler, a turbine, internal combustion engine, or any other type of appropriate application.

Both the foregoing general description and the following detailed description are exemplary and explanatory only, and are not restrictive of the invention as claimed. The accompanying drawings, which are incorporated herein by reference, and constitute a part of the specification, illustrate certain embodiments of the invention and, together with the detailed description, serve to explain the principles of the present invention.

DETAILED DESCRIPTION OF THE PREFERRED EMBODIMENTS

As illustrated by the data in the accompanying tables and graphs, and disclosed in the accompanying claims, the present invention is a fuel additive for motor fuels for internal combustion engines, comprising: nitroparaffin, and a solubilizing agent. As embodied herein, the solubilizing agent may be any of various esters, including without limitation: ester oil, alcohol, amines and/or aromatic hydrocarbon. The invention comprises an improved fuel additive formulation, and method of making and using the formulation.

The present inventors have developed a new method of creating a stable mixture of nitroparaffins in gasoline and/or diesel fuel, namely by introduction of an ester oil and/or other solubilizing agent and/or aromatic hydrocarbon component and a mixing procedure of the present invention. The present inventors have discovered that low concentrations of additives reduce emissions, provided the ester oil has been modified in accordance with the present invention, or another suitable solubilizing agent is used. Specifically, the ester oil is modified to remove, or not to introduce, the tricresyl phosphate component of commercially available ester oils, and the solubilizing agent has at least one chemically polar end and at least one chemically non-polar end. Toxicity has been reduced by eliminating, modifying, and/or replacing components and by reducing the concentration of additive in the fuel, while reducing emissions.

Emission reductions are achieved by the removal, introduction, modification, or reduction of various components. For example, tricresyl phosphate has been substantially removed from, or not introduced into, commercially available ester oil; a solubilizing agent has been substituted for the ester oil; 2-nitropropane has been reduced or removed from the prior known formulation; the concentration of ester oil and/or solubilizing agent, and nitromethane have been reduced relative to certain prior known formulations; and/or the overall concentration of additive in the fuel has been reduced to a level lower than that typically used in prior known inventions.

The present inventors have found that the solubility of nitromethane, which is normally highly explosive and dangerous, is reduced when introduced as a component of the fuel mixture (c. 170 mg/l), to the order of the solubility of gasoline hydrocarbons (c. 120 mg/l), and substantially lower than the relatively high water solubility of a blend of 10% MTBE in gasoline (5000 mg/l). The present inventors have found that careful balancing of the formulation between the various components is necessary to make the product safely, while maintaining superior emission reduction capacity.

The present inventors have developed a number of improvements that they believe contribute to the beneficial effect of the invention on emissions.

First, the ester oil component of the present invention comprises ester oil that has been modified from its commercially available form. In the present invention, ester oil is present not for the purpose of upper cylinder lubrication in order to reduce friction as it was in prior known formulations but, rather, to enhance the miscibility of the nitroparaffins in gasoline. Commercially available ester oils typically include various additive packages. The additives typically include a variety of substances that impart various characteristics to the ester oil, such as resistance to combustion, corrosion resistance, stability, and a wide variety of other properties. Prior inventors and the formulations known prior to the present invention taught that the ester oil should be used in the form in which it was commercially available, namely, including the additives found in commercially available ester oil products.

A number of these additives, however, are highly toxic and are known environmental contaminants. In addition, some impart properties that are not desired in a fuel formulation, such as flame retardancy. The function of these flame retardants is to preserve the ester oil by preventing it from burning. In this manner, the ester oil remains available to lubricate the upper cylinder. Some of the prior inventors, including Michaels, specifically taught the benefits that flow from retaining this property. Moreover, the ester oil is present in such a low concentration in the present invention (i.e., preferably about 1.8 volume percent of the additive formulation, or 0.00142 volume percent of the fuel) that the flame retardant properties of commercially available ester oil would be expected by persons of ordinary skill in the art to have a negligible effect, if any, on the performance of the present invention.

The present inventors, however, in contrast to each of the prior known formulations, have modified the additive package of the ester oil, producing unexpected, beneficial properties. The present inventors, working with commercially available ester oil (Mobil Jet II Oil) have removed or eliminated one of the additive components—tricresyl phosphate—from the ester oil. Although tricresyl phosphate is toxic, it is present in commercially available formulations of Mobil Jet II Oil. Contrary to the teachings of Michaels to employ commercially available ester oil, the present inventors have modified the ester oil of the present invention to be substantially free of this toxic component. The present inventors believe that chemically removing the tricresyl phosphate and/or no adding it has modified the ester oil in a manner beneficial to the present invention. It is within the knowledge of one of ordinary skill in the art how to modify an ester oil to remove, or not to introduce, tricresyl phosphate. In conjunction with the other features of the present invention, the present inventors have discovered that the performance and ability to lower emissions was improved by the present invention to an unexpected degree.

The ester oil in the additive, and the additive in the fuel, are present in such low concentrations in the present invention that persons of ordinary skill in the art would have expected that removal of one component of the ester oil would produce no effect on the performance of the fuel or its ability to reduce emissions, particularly in view of the teachings of Michaels. Yet, the present inventors have observed precisely those benefits from the present invention. The present inventors believe that the removal of the tricresyl phosphate component of the ester oil may have affected the invention in any of several possible ways: by forming a new composition of matter, by modifying the ester oil or one or more of its components in some manner; by emulsifying or suspending the nitroparaffins in the fuel; by some form of ionic reaction; by some form of methylation reaction; or by affecting the solubility of one or more of the components of the present invention. The inventors are continuing their investigation.

Persons of ordinary skill in the art would not have expected the benefits of the present invention, at the time the invention was made. Removal of the flame retardant involves a trade off. Presence of the flame retardant enables the ester oil to survive combustion and provide increased upper cylinder lubrication. Prior inventors, such as Michaels, have attributed at least some measure of the improved performance of their additives to improved upper cylinder lubrication from the ester oil. On the other hand, the present inventors have discovered that improved upper cylinder lubrication is not as critical to the present invention as the benefits resulting from the removal of the flame retardant. Whereas Michaels focused on increasing horsepower and fuel efficiency, both of which were related to improving upper cylinder lubrication, the present inventors are attempting to reduce emissions, and in particular emissions on cold start-up. In this regard, removal of the tricresyl phosphate from the ester oil produces unexpected, beneficial results. In addition, a solubilizing agent may be substituted for the ester oil. The solubilizing agent will be described in greater detail in the following pages.

Second, 2-nitropropane is eliminated from certain embodiments of the present invention. Rather, 1-nitropropane is used in lieu of 2-nitropropane in these embodiments of the present invention. 2-nitropropane is toxic. Removal of 2-nitropropane and replacement with the less toxic 1-nitropropane enhances safety by reducing potential exposure to toxics. In contrast, prior known formulations, such as Michaels', used 2-nitropropane exclusively. Others simply failed to distinguish between 1-nitropropane and 2-nitropropane.

Third, the present inventors have preferably reduced the ratio of ester oil to nitroparaffin. This, in turn, reduces emissions from combustion of the ester oil. The ratio of ester oil to nitroparaffin has been reduced to levels well below the levels employed in many prior known formulations. Michaels teaches the use of ester oil at levels of 10 to 90% of the additive formulation, in contrast to the preferred range of less than about 10% and more preferrably less than about 2%, in the present invention. Michaels taught that higher concentrations of ester oil were necessary to provide upper cylinder lubrication and to make a homogenous fuel. He recommends a maximum concentration of 25% ester oil to prevent potential engine fouling. The present inventors have produced beneficial effects at concentrations far below the lower limits of Michaels' range.

Fourth, toluene has been added in certain embodiments of the present invention to enhance engine combustion and improve emissions. Toluene is a component of gasoline. Toluene emulsifies and/or improves the solubility of the nitroparaffins in gasoline, reducing the amount of ester oil required. This substitution permits the present inventors to substitute a lower emission ingredient (toluene) for a higher emission ingredient (ester oil). In the process, it allows for the proper emulsion of the nitroparaffins into the additive and, ultimately, the fuel. The present inventors have found that toluene enhances and augments the effect of the ester oil in the present invention to enhance the solubility of nitroparaffins in gasoline.

Fifth, the present inventors preferably have limited the amount of nitromethane in the formulation. Nitromethane is highly toxic as well as dangerous. It presents a substantial hazard of explosion and danger to personal safety. Limiting the concentration of nitromethane reduces the risk and lowers the toxicity of the additive and, in turn, of the fuel in which it is used.

The toxic nature of the ingredients was not considered in earlier patents. The present inventors have made several modifications to the formulation of the present invention to reduce the health risks posed by the toxic components of the formulation. The inventors have also modified the formulation to reduce emission from engines using the present invention. The low concentration of additive package in the fuels of the present invention achieves these objectives. The higher concentration employed in prior known formulations and disclosed in prior patents would result in higher emission of NOx, uncombusted nitroparaffins, and total hydrocarbons and non-methane hydrocarbons. They would also tend to increase ozone formation. This would result from both the higher concentrations of ester oils and higher concentrations of nitroparaffins, typically found in the prior known formulations. At the relatively high concentrations of ester oils and nitromethane disclosed in prior known formulations, the fuel would be substantially more toxic and pose greater risks to ground water. Emissions would be increased in general, specifically of toxic materials. The present inventors have found that only at low concentrations of ester oil and nitromethane can emissions be reduced.

Sixth, the present inventors preferably have systematized the production of the formulation of the present invention. Prior known additives have been prepared in small quantities, on a batch basis, often without the benefit of production standards, and little to no attention to production quality control.

In contrast to the process of the present invention, Michaels states that there is no general rule as to the amount of ester oil or solubilizing agent needed because gasoline varies by type and varies widely even from the same refinery, depending on multiple variables such as: the available crudes, refinery operations, and the time of year. Michaels' approach requires continuous monitoring to ensure that proper homogeneous fuels are being blended. Michaels' approach for determining the proper blend of ester oil, nitroparaffin, and gasoline requires that nitroparaffin be added to the gasoline, then that sufficient ester oil be added to the gasoline in increments. Specifically, Michaels requires the addition of a small amount of ester oil followed by mixing, followed by the addition of added amounts of ester oil, repeating the process until a homogeneous blend is obtained in the fuel. Michaels does not disclose the use of a solubilizing agent as disclosed and claimed by the present inventors.

Thus, Michaels' fuels must be mixed in a batch process. In contrast, the present invention is not so limited. The present invention can be added to any fuel. Moreover it can be added in standard amounts, as continuous adjustment is not required in order to make a homogeneous fuel. Thus, the present invention allows the additive to be made and blended in a batch or continuous process that can readily be standardized for a production-scale operation.

The present inventors anticipate that a preferred production scale process would involve the following steps:

1. In a clean stainless steel vessel;
2. Per 55 gallons of additive, add 1 gallon of modified ester oil (from which substantially all of the tricresyl phosphate has been removed), or a solubilizing agent;
3. Add 5 gallons of toluene;
4. Let ingredients stand 10 minutes at ambient temperature, do not mix;
5. Add 10 gallons of nitromethane;
6. Add 10 gallons of nitroethane;
7. Add 29 gallons of 1-nitropropane;
8. Mix by aeration through a narrow tube at low pressure, at ambient temperature, venting the mixing vessel to ambient atmospheric pressure;
9. Recover nitromethane evaporate through the use of a condenser in the vent;
10. Store the additive formulation until ready for use;
11. Mix the additive with motor fuel (gasoline, gasoline and MTBE, gasoline and ethanol, and/or gasoline and ethanol and MTBE), preferably at a concentration of 0.1 oz. per gallon of fuel (0.07812%), in gasolines, and preferably at a concentration of 0.2 oz. per gallon of fuel (0.15624%) in diesel fuel.

The inventors believe that the unexpected results of the present invention are attributable, at least in part, to the processing and order of addition of the ingredients, as set forth above. In a preferred embodiment of the present invention, the mixing step preferably is accomplished by bubbling air at low pressure (10-psig) through a narrow diameter tube (¼"-⅜" in diameter), for 10-15 minutes.

It will be apparent to persons of ordinary skill in the art that modifications and variations may be made in the manner of combining the ingredients to produce the additive formulation of the present invention. For example, the mixing vessel could be epoxy-lined steel or any other suitable material. To the extent that reactive intermediaries or reaction products are formed, the selection of material for the mixing vessel may be guided by the desire not to cause any further interaction between the ingredients or, alternatively, to facilitate or catalyze any reactions that may occur. Moreover, the process may be run on a batch or continuous basis. On a continuous basis, the residence times may be adjusted to achieve the above hold times. Moreover, the toluene and ester oil may be mixed separately, either on a batch or continuous basis. Similarly, the nitromethane and nitroethane ingredients may be combined, in order to reduce the material-handling difficulties of nitromethane. Thus, it is intended that the invention include the variations and permutations of the method of combining the ingredients, provided they come within the scope of the appended claims and their equivalents.

The method of preparing the formulation of the present invention includes steps to ensure that the components are properly mixed, while reducing off-gassing which would otherwise occur during processing. For example, the present inventors use a simple condenser to collect the nitromethane released during processing.

Seventh, the present inventors anticipate that, in contrast to the "homogeneous" "blend" disclosed by Michaels, the present formulation may preferably comprise one or more reaction products, formed by the interaction of various of the components of the formulation. Alternatively, modification of the ester oil may have changed the composition of the ester oil component. As a further alternative, the present inventors may emulsify or suspend the nitroparaffins, ester oil, and/or toluene, in the fuel. Ionic or methylation reactions may have occurred, or the combination of the ingredients may affect the solubility of one or more components in others. The present inventors are continuing their evaluations, attempting to discover the precise nature of these potential interactions in the present invention.

Finally, the present invention achieves improved performance, as well as reduced emissions at lower concentrations of additive than prior known formulations. Wholly apart from the existence of any reaction products, reactive intermediaries, or interaction between the components of the invention, the present invention differs from prior known formulations in various ways. Whereas Michaels combined nitroparaffins and ester oils in a ratio of from 10 to 90% to 90 to 10%, the present invention combines them in proportions outside those ranges, namely, less than about 20%, and preferably less that 10%, ester oil to nitroparaffin. More specifically, the present invention would limit the ester oil to nitroparaffin ratio to less than about 10%. In another preferred embodiment of the present invention, the ratio of ester oil to nitroparaffin would be less than about 2%, namely, about 1.8% by volume.

The amount of additive used per gallon of fuel in the present invention is well below the amounts taught by Michaels. Whereas Michaels includes additive at levels of 5% to 95% of the amount of gasoline, the additive of the present invention is typically used in amounts less than about 20%. More specifically, the amount of additive is generally less than 10%, or 5%. In a preferred embodiment of the present invention, the amount of additive preferably is maintained below about 0.1%, namely about 0.08% (or 0.1 of an ounce of additive per gallon of fuel).

The present invention comprises a fuel additive formulation and a method of making and using same. The fuel additive formulation of the present invention preferably comprises: 1-nitropropane, nitroethane, nitromethane, toluene, and ester oil and/or a solubilizing agent When used as a motor fuel for automobiles and other internal combustion engines, the present invention preferably comprises from 0.01% to less than about 5% additive by volume, in gasoline.

In these ranges, the amount of nitroparaffin in Michaels' fuels is well above the range of the present invention. Whereas Michaels includes nitroparaffin in amounts ranging from 0.5% to 85.5%, the amount of nitroparaffin in fuels of the present invention typically ranges from 0.064% to 7.6% by volume, and preferably below 0.5% by volume.

The present invention comprises a continuous range of combinations of ester oil and/or toluene, on one hand, and nitroparaffin, on the other. The present inventors believe that the function of the ester oil and toluene in the present invention is to allow the nitroparaffins to react with, emulsify with, or become soluble in, gasoline. Either toluene and/or ester oil may be used. Preferably both are used. The following table illustrates, without limitation, some of the ranges of toluene/ester to nitroparaffin of the present invention:

TABLE 6

Ratio of Toluene/Ester Oil to Nitroparaffin in the Additive of the Present Invention

| Toluene and/or Ester Oil (Volume percent) | Nitroparaffin |
|---|---|
| 0 ≦ x ≦ c. 20% | c. 80 ≦ x ≦ c. 100% |
| 0 ≦ x ≦ c. 15% | c. 85 ≦ x ≦ c. 100% |

TABLE 6-continued

Ratio of Toluene/Ester Oil to Nitroparaffin in the Additive of the Present Invention

| Toluene and/or Ester Oil (Volume percent) | Nitroparaffin |
|---|---|
| 0 ≦ x ≦ c. 10% | c. 90 ≦ x ≦ c. 100% |
| 0 ≦ x ≦ c. 5% | c. 95 ≦ x ≦ c. 100% |
| c. 0.1 ≦ x ≦ c. 10% | c. 90 ≦ x ≦ c. 99.9% |
| c. 0.1 ≦ x ≦ c. 5% | c. 95 ≦ x ≦ c. 99.9% |
| c. 0.5 ≦ x ≦ c. 3.5% | c. 96.5 ≦ x ≦ c. 99.5% |
| c. 0.5 ≦ x ≦ c. 2.5% | c. 97.5 ≦ x ≦ c. 99.5% |
| c. 1.0 ≦ x ≦ c. 2.5% | c. 97.5 ≦ x ≦ c. 99.0% |

The present invention comprises one or more nitroparaffins. As embodied herein, the nitroparaffins of the present invention comprise: nitromethane, nitroethane, and/or nitropropane. Each may be present in combination with, or to the exclusion of, the others. For example, each of nitromethane, nitroethane, and nitropropane may comprise from 0% to 100% of the nitroparaffin component of the invention identified in Table 6. In a preferred embodiment of the present invention, nitromethane is the preferred nitroparaffin. Preferably, nitromethane is present as 20% to 40% of the nitroparaffin fraction of the additive, and more preferably, as 20% of the additive formulation. Table 7 illustrates, again without limitation, some of the ranges of nitroparaffins of the present invention:

TABLE 7

Relative Proportions of Various Nitroparaffins in the Nitroparaffin Component of the Additive of the Present Invention

| Nitromethane | Nitroethane | Nitropropane |
|---|---|---|
| 0 ≦ x ≦ 100% | 0 ≦ x ≦ 100% | 0 ≦ x ≦ 100% |
| c. 10 ≦ x ≦ c. 50% | c. 0 ≦ x ≦ c. 90% to c. 0 ≦ x ≦ c. 50% | c. 0 ≦ x ≦ c. 90% to c. 0 ≦ x ≦ c. 50% |
| c. 20 ≦ x ≦ c. 40% | c. 0 ≦ x ≦ c. 80% to c. 0 ≦ x ≦ c. 60% | c. 0 ≦ x ≦ c. 80% to c. 0 ≦ x ≦ c. 60% |
| c. 20 | c. 0 ≦ x ≦ c. 80% | c. 0 ≦ x ≦ c. 80% |
| c. 20 | c. 20 | c. 60 |
| c. 10 | c. 0 ≦ x ≦ c. 90% | c. 0 ≦ x ≦ c. 90% |
| c. 10 | c. 10 | c. 80 |

Although the present inventors believe that the influence of nitromethane is more important than other nitroparaffins in the effect of the present invention, nitromethane is relatively more dangerous, in terms of material handling, environmental, and public health risk, than nitroethane and/or nitropropane. Nitromethane is more toxic. Moreover, nitromethane poses a greater explosion hazard, necessitating careful material handling steps that are well known to persons of ordinary skill in the art of handling such volatile compounds. It is imperative in order to practice the invention that generally accepted material handling procedures be followed in order to reduce the risk of bodily harm and/or explosion hazard.

Based upon the above continuous ranges of composition, certain ranges of the principal components of the present invention are illustrated, without limitation, in Table 8:

TABLE 8

Components of the Present Invention

| Component | Volume Percent of Additive | Volume Percent of |
|---|---|---|
| 1-nitropropane | $0 \leqq x \leqq 80\%$ | $0 \leqq x \leqq 0.0624$ |
| Nitroethane | $0 \leqq x \leqq 80\%$ | $0 \leqq x \leqq 0.0624$ |
| Nitromethane | $0 \leqq x \leqq 80\%$ | $0 \leqq x \leqq 0.0624$ |
| Toluene | $0 \leqq x \leqq 20\%$ | $0 \leqq x \leqq 0.0156$ |
| Ester Oil | $0 \leqq x \leqq 20\%$ | $0 \leqq x \leqq 0.0156$ |

The relative amounts of the various nitroparaffins are adjusted to compliment one another, as are the relative amounts of toluene and ester oil. The relative amount of nitroparaffin, on one hand, and ester oil and toluene on the other, are also adjusted to compliment one another. As will be seen from Table 8, the proportions of the components of the present invention are below the ranges of those components in prior known formulations.

In one preferred embodiment of the present invention, the present invention comprises:

TABLE 9

Formulation of a Preferred Embodiment of the Present Invention

| Component | Parts | Proportion of Fuel |
|---|---|---|
| 1-nitropropane | 29 | 0.026 |
| Nitroethane | 10 | 0.009 |
| Nitromethane | 10 | 0.009 |
| Toluene | 5 | 0.00455 |
| Ester Oil | 1 | 0.00091 |

The ester oil of the present invention includes little to no flame retardant. The present inventors believe that this modification enables the present invention to reduce emissions on cold start up. This result was surprising, particularly given the long-standing and widespread use of various commercial, additive-containing ester oils. The present inventors have found, however, that this modification results in improved cold start up emissions to a degree that more than compensates for any negative effect in terms of reduced upper cylinder lubrication through combustion and loss of the ester oil.

The present inventors have conducted a series of experiments to test the performance of the present invention relative to various known formulations. These formulations are identified in the following examples.

EXAMPLE 1

Indolene was used as a standard reference fuel. The Indolene was purchased from Philips Chemical Company: UTG 96 (OBPU9601).

EXAMPLE 2

Indolene was blended with EChem. The Indolene was the standard reference fuel, of Example 1, above. The EChem formulation used in testing the present invention was obtained from Don Young. The EChem formulation was prepared by: combining 1 gallon of commercially available Mobil Jet II Oil and 5 gallons of toluene in an epoxy-lined steel drum that had been flushed; allowing the toluene/ester oil mixture to stand for 10 minutes; adding 10 gallons of nitromethane; adding 10 gallons of nitroethane; adding 29 gallons of 1-nitropropane; and aerating the ingredients through a narrow tube at low pressure, and ambient temperature; to produce the additive. The EChem additive was added to Indolene at a rate of 0.1 oz. per gallon of fuel.

EXAMPLE 3

The MAZ 100 formulation of the present invention was prepared as follows:

1. An epoxy-lined 55 gallon drum was flushed;
2. 1 gallon of ester oil (modified Mobil Jet II Oil, without the tricresyl phosphate additive) was added;
3. 5 gallons of toluene were added;
4. The ester oil and toluene were allowed to stand 10 minutes at ambient temperature and pressure;
5. 10 gallons of nitromethane were added to the mixture;
6. 10 gallons of nitroethane were added to the mixture;
7. 29 gallons of 1-nitropropane were added to the mixture;
8. The components were mixed by gentle aeration, through a narrow tube at low pressure, at ambient temperature, venting the mixing vessel to ambient atmospheric pressure;
9. The MAZ 100 additive formulation was then stored until needed for testing;
10. The additive was mixed with a reference motor fuel (indolene), at a concentration of 0.1 oz. of MAZ 100 additive per gallon of Indolene (0.07812%).

EXAMPLE 4

Indolene was procured as noted above in Example 1, from Phillips Chemical Company. MBE was added at 11%.

EXAMPLE 5

RFG II was secured from Phillips Chemical Company. The RFG formulation used in the testing was California P-II CERT Fuel (0CPCP201).

The present inventors have run a number of comparisons of the present formulation relative to other fuels. The results are tabulated below, in Tables 10 through 13.

TABLE 10

MAZ 100 Formulation Results of Emission Testing

| (Grams emitted per mile) | Indolene | EChem 1 | MAZ 100 |
|---|---|---|---|
| Carbon Monoxide | 2.090 | 2.142 | 2.056 |
| NO*x* | 0.562 | 0.565 | 0.546 |
| Total Hydrocarbons | 0.311 | 0.310 | 0.256 |
| Non-Methane Hydrocarbons | 0.284 | 0.282 | 0.229 |
| Ozone | 0.965 | 1.016 | 0.775 |

TABLE 11

MAZ 100 Formulation vs. EChem 1 Formulation Improvement over Indolene

| | EChem 1 | MAZ 100 | Difference |
|---|---|---|---|
| Carbon Monoxide | −2% | 2% | 4% |
| NO*x* | −1% | 3% | 4% |
| Total Hydrocarbons | 0 | 18% | 18% |
| Non-Methane Hydrocarbons | 1% | 19% | 18% |
| Ozone | −5% | 20% | 25% |

MAZ 100 was tested in a 1992 Plymouth Voyager using a chassis dynamometer. The tests were conducted at the University of California, Riverside, College of Engineering Center for Environmental Research and Technology (CE-CERT) facility, following the Federal Test Protocol (FTP). A total of four fuels were tested to evaluate the performance of the additive in gasoline. The four fuels tested were: (Fuel 1) Indolene; (Fuel 2) Indolene with 0.1 percent by volume MAZ 100; (Fuel 3) Indolene with 11 percent by volume MTBE; and (Fuel 4) Phase II Federal RFG.

The MAZ 100 formulation of the present invention was prepared by Magnum Environmental Technologies, Inc., staff prior to the initiation of testing. The staff acquired nitromethane, nitroethane, and 1-nitropropane from Angus Chemicals, and Synthetic Ester Oil (TCP-free Mobil Jet 2) from Mobil Chemical Company and they acquired toluene from Van Waters & Rogers Chemical Distributors. The staff mixed 10 parts nitromethane, 10 parts nitroethane, 29 parts 1-nitropropane, 5 parts toluene, and 1 part ester oil in the manner described above to form the MAZ 100 additive. This material was provided to CE-CERT and used to conduct the tests at CE-CERT.

CE-CERT acquired certified Indolene (UTG 96) and certified Phase II California RFG from the Phillips Chemical Company. Commercial Grade MTBE (95% MTBE) was obtained by CE-CERT from ARCO. Magnum Environmental Technologies supplied the "MAZ 100" additive. CE-CERT staff prepared two of the four test fuels (Fuel 2 and Fuel 3 above) by blending either the "MAZ 100" additive or MTBE with the appropriate certified gasoline prior to conducting the tests. CE-CERT staff prepared Fuel 2 by placing 0.1 percent by volume of the MAZ 100 into Indolene and mixing the resulting test fuel CE-CERT staff prepared Fuel 3 by placing 11 percent by volume of MTBE into Indolene and mixing the resulting test fuel. No mixing was necessary for Fuel 1 and Fuel 4.

Each fuel was tested in the 1992 Voyager following the Federal Test Protocol. The test was repeated three times for each fuel. During each test run, exhaust samples were collected in Tedlar bags and the contents of the each bag were analyzed for the presence of: (1) carbon monoxide (CO), (2) nitrogen oxides ($NO_x$); (3) non-methane hydrocarbons; and (4) volatile organic compounds (VOCs) that are precursors to ozone formation to enable prediction of the ozone formation potential for each test fuel.

The Federal Test Protocol consists of three phases: Phase 1 corresponds to cold starts; Phase 2 corresponds to the transient phase in which the engine speed is varied; and Phase 3 corresponds to the hot start phase. Exhaust samples were collected during each of the three phases of the FTP in separate bags during each test run. The first phase, corresponding to cold starts was collected in Bag 1 for each test run. The exhaust samples corresponding to the transient phase were collected in Bag 2 for each test run. The exhaust samples corresponding to the hot start phase were collected in Bag 3 for each test run.

All four test fuels were tested in the same 1992 Plymouth Voyager and a sufficient volume of test fuel was rinsed through the vehicle's fuel system and drained to remove traces of the previous test fuel to assure that the results represent the current test fuel. Each test fuel used was also subjected to chemical analysis to verify the hydrocarbon and other compounds present in the test fuel.

The measured CO, $NO_x$, non-methane hydrocarbons, and ozone formation potential for each test fuel were recorded and compared for all four fuels. The present inventors have run a number of comparisons of the present formulation relative to other fuels. The results are tabulated below, in Tables 12 and 13. The present invention is represented by the information for "MAZ 100":

TABLE 12

MAZ 100 Formulation Results of Emissions Testing (grams/mile)

| | Indolene | Indolene Plus 11% MTBE | RFG II | Indolene Plus MAZ 100 |
|---|---|---|---|---|
| Carbon Monoxide | 2.090 | 2.488 | 2.121 | 2.056 |
| NOx | 0.562 | 0.593 | 0.527 | 0.546 |
| Total Hydrocarbons | 0.311 | 0.237 | 0.287 | 0.256 |
| Non-Methane Hydrocarbons | 0.284 | 0.213 | 0.255 | 0.229 |
| Ozone | 0.966 | N/A* | 0.807 | 0.775 |

*Results were not available.

Based upon the above information, the following percentage improvements in emissions were observed:

TABLE 13

MAZ 100 Formulation Emissions Improvement Relative to Indolene

| | Indolene Plus 11% MTBE | RFG II | Indolene Plus MAZ 100 |
|---|---|---|---|
| Carbon Monoxide | −19% | −1% | 2% |
| NOx | −5% | 6% | 3% |
| Total Hydrocarbons | 24% | 8% | 18% |
| Non-Methane Hydrocarbons | 25% | 10% | 19% |
| Ozone | N/A* | 16% | 20% |

*Results were not available.

For the test vehicle used, the present invention produced results superior to the reference fuel, and MTBE, on numerous criteria. The present inventors believe that the results of the present invention may not be reproduced using a vehicle made after approximately 1994, as such vehicles are equipped with oxygen sensors and advanced computer engine controls that can rapidly adjust fuel to oxygen ratios and timing minimizing the beneficial effects of the additive on emissions. Nonetheless, the present inventors believe that the beneficial effects of the present invention in the 1992 vehicle are due to the modifications and variations of the invention relative to prior known formulations that failed to achieve the beneficial effects of the present invention.

It will be apparent to those skilled in the art that various modifications and variations can be made in the construction and configuration of the present invention without departing from the scope or spirit of the invention. Thus, it is intended that the present invention cover the modifications and variations of the invention provided they come within the scope of the appended claims and their equivalents. For example, the additive formulation may be prepared comprising a nitroparaffin and a solubilizing agent.

As illustrated by the data in the accompanying tables and graphs, and disclosed in the accompanying claims, a preferred embodiment of the present invention is a fuel additive for motor fuels for internal combustion engines, comprising nitroparaffin and a solubilizing agent, wherein the solubilizing agent comprises at least one chemically polar end and at least one chemically non-polar end. The chemically polar ends may comprise ether groups, or any other suitable chemically polar group. The chemically non-polar ends may comprise hydrocarbon groups, or any other suitable chemically non-polar group.

A preferred embodiment of the present invention is a fuel additive for motor fuels for internal combustion engines, comprising nitroparaffin and an ester compound, wherein the ester compound comprises at least one chemically polar end and at least one chemically non-polar end. The chemically polar ends may comprise ether groups, or any other suitable chemically polar group. The chemically non-polar ends may comprise hydrocarbon groups, or any other suitable chemically non-polar group.

A preferred embodiment of the present invention is a fuel additive for motor fuels for internal combustion engines, comprising nitroparaffin and a simple ester compound, wherein the simple ester compound comprises at least one chemically polar end and at least one chemically non-polar end. The chemically polar ends may comprise ether groups, or any other suitable chemically polar group. The chemically non-polar ends may comprise hydrocarbon groups, or any other suitable chemically non-polar group. The simple ester compound may be prepared by reacting ether alcohols and monobasic acids, or any other suitable reactants that would give rise to a simple ester compound. The simple ester compound may be a simple ether alcohol ester.

A preferred embodiment of the present invention is a fuel additive for motor fuels for internal combustion engines, comprising nitroparaffin and an amino alkane compound, wherein the amino alkane compound comprises at least one chemically polar end and at least one chemically non-polar end. The chemically polar ends may comprise amino groups, or any other suitable chemically polar group. The chemically non-polar ends may comprise hydrocarbon groups, or any other suitable chemically non-polar group. The amino alkane compound may have the following formula:

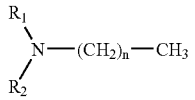

wherein $R_1$ and $R_2$ are either hydrogen, alkyl (methyl, ethyl, propyl, or any other compatable group) or aryl, and n can vary from 1 to 8. The main hydrocarbon chain may also be branched. The compound may also contain two or more amino groups having alkyl or aryl substituents. Compounds containing various combinations of ether, ester and amino groups are also expected to be useful as solubilizing agents for nitroalkanes in gasoline.

In a preferred embodiment of the present invention, the amino alkane compounds may further comprise:

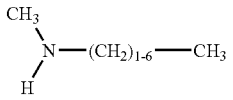

Where n=6 would be (1-methylaminoheptane);

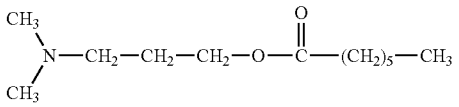

1-Dimethylamino-3-hexanoyloxypropane;

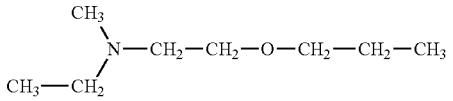

1-(N-Ethyl-N-methyl)amino-2 proyloxyethane; and

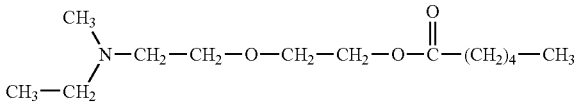

1-(N-Ethyl-N-methyl)amino-2-oxy-pentanoyloxyethyl ether.

The simple ether alcohol esters may be synthesized by several routes known by persons of ordinary skill in the art. The acid chloride route was chosen to synthesize the bulk of these esters since the synthesis is relatively fast, and is easy to accomplish in excellent yields. This route would not be the choice for commercial production since the starting acid chlorides are considerably more expensive than the corresponding acids. Also, the acid chloride synthesis involves the use of ether, a volatile and explosive compound.

The preferred commercial route to obtain the identical esters would be by the direct reaction of the alcohol with the acid, over an acid resin catalyst. This route involves the removal of water during reaction, several filtrations, and a distillation step, common methods in industrial chemistry.

The following section describes six additional examples for preparing these esters using two alcohols and two acid chlorides, in the presence of an amine. Example 12 describes the synthesis of one of these esters using the direct reaction route of adding the acid to the alcohol, in the presence of an acid resin catalyst. In Example 12, the acid catalyst is recovered and is reusable, and so is the n-octane, which is recovered by distillation. Thus Example 12 would be the more economical and safe route to obtain these esters.

EXAMPLE 6

Preparation of Diethylene Glycol Ethyl Ether (carbitol™) Ester of n-Octanoic Acid (C8)

A 3 liter flask equipped with a magnetic stirrer, thermometer and addition funnel, was charged with 147 grams of diethylene glycol ethyl ether, 111 grams of triethyl amine and 200 ml of diethyl ether. The flask was than partially immersed in a cold water bath. The addition funnel was then charged with 163 grams of n-octanoyl chloride. The acid chloride was added to the flask while stirring. The entire mixture was maintained in the water bath, while stirring, for two hours, to allow the exothermic reaction to subside. After the exotherm subsided, the flask was kept in cold water for an additional hour. The reaction mixture was then filtered to remove the amine hydrochloride solid. The filtrate was then vacuum stripped from a heated water bath at approximately 200 mm pressure. The residue was then extracted once with a 2% aqueous sodium sulfate and was dried over solid anhydrous sodium sulfate and filtered to give the final product.

EXAMPLE 7

Preparation of Diethylene Glycol Ethyl Ether Ester of n-Hexanoic Acid (C6)

A 3 liter flask equipped with a magnetic stirrer, thermometer and addition funnel, was charged with 147 grams of diethylene glycol ethyl ether, 111 grams of triethyl amine and 200 ml of diethyl ether. The flask was then partially immersed in a cold water bath. The addition funnel was then charged with 163 grams of n-hexanoyl chloride. The acid chloride was added to the flask while stirring. The entire mixture was maintained in the water bath, while stirring, for two hours, to allow the exothermic reaction to subside. After the exotherm subsided, the flask was kept in cold water for an additional hour.

The reaction mixture was then filtered to remove the amione hydrochloride solid. The filtrate was then vacuum stripped from a heated water bath at approximately 200 mm pressure. The residue was then extracted once with a 2% aqueous sodium sulfate and was dried over solid anhydrous sodium sulfate and filtered to give the final product.

EXAMPLE 8

Preparation of Ethylene Glycol Ethyl Ether (cellosolve™) Ester of n-Hexanoic Acid A 3 liter flask equipped with a magnetic stirrer, thermometer and addition funnel, was charged with 147 grams of diethylene glycol ethyl ether, 111 grams of triethyl amine and 200 ml of diethyl ether. The flask was then partially immersed in a cold water bath. The addition funnel was then charged with 163 grams of n-hexanoyl chloride. The acid chloride was added to the flask while stirring. The entire mixture was maintained in the water bath, while stirring, for two hours, to allow the exothermic reaction to subside. After the exotherm subsided, the flask was kept in cold water for an additional hour.

The reaction mixture was then filtered to remove the amione hydrochloride solid. The filtrate was then vacuum stripped from a heated water bath at approximately 200 mm pressure. The residue was then extracted once with a 2% aqueous sodium sulfate and was dried over solid anhydrous sodium sulfate and filtered to give the final product.

EXAMPLE 9

Preparation of Ethoxy Ethyl Ether Ester of n-Octanoic Acid

A 3 liter flask equipped with a magnetic stirrer, thermometer and addition funnel, was charged with 147 grams of diethylene glycol ethyl ether, 111 grams of triethyl amine and 200 ml of diethyl ether. The flask was then partially immersed in a cold water bath. The addition funnel was then charged with 163 grams of n-hexanoyl chloride. The acid chloride was added to the flask while stirring. The entire mixture was maintained in the water bath, while stirring, for two hours, to allow the exothermic reaction to subside. After the exotherm subsided, the flask was kept in cold water for an additional hour.

The reaction mixture was then filtered to remove the amione hydrochloride solid. The filtrate was then vacuum stripped from a heated water bath at approximately 200 mm pressure. The residue was then extracted once with a 2% aqueous sodium sulfate and was dried over solid anhydrous sodium sulfate and filtered to give the final product.

EXAMPLE 10

Preparation of Ethoxy Ether Ester with a mixture of n-Octanoic Acid and n-Hexanoic Acids A 3 liter flask equipped with a magnetic stirrer, thermometer and addition funnel, was charged with 147 grams of diethylene glycol ethyl ether, 111 grams of triethyl amine and 200 ml of diethyl ether. The flask was then partially immersed in a cold water bath. The addition funnel was then charged with 81.5 grams of n-octanoyl chloride and 81.5 grams of n-hexanoyl chloride. The acid chloride was added to the flask while stirring, for two hours, to allow the exothermic reaction to subside. After the exotherm subsided, the flask was kept in cold water for an additional hour.

The reaction mixture was then filtered to remove the amione hydrochloride solid. The filtrate was then vacuum stripped from a heated water bath at approximately 200 mm pressure. The residue was then extracted once with a 2% aqueous sodium sulfate and was dried over solid anhydrous sodium sulfate and filtered to give the final product.

EXAMPLE 11

Preparation of Diethylene Glycol Ethyl Ether Ester with a mixture of n-Octanoic Acid and n-Haxanoic Acids A 3 liter flask equipped with a magnetic stirrer, thermometer and addition funnel, was charged with 147 grams of diethylene glycol ethyl ether, 111 grams of triethyl amine and 200 ml of diethyl ether. The flask was then partially immersed in a cold water bath. The addition funnel was then charged with 81.5 grams of n-octanoyl chloride and 81.5 grams of n-hexanoyl chloride. The acid chloride was added to the flask while stirring. The entire mixture was maintained in the water bath, while stirring, for two hours, to allow the exothermic reaction to subside. After the exotherm subsided, the flask was kept in cold water for an additional hour.

The reaction mixture was then filtered to remove the amione hydrochloride solid. The filtrate was then vacuum stripped from a heated water bath at approximately 200 mm pressure. The residue was then extracted once with a 2% aqueous sodium sulfate and was dried over solid anhydrous sodium sulfate and filtered to give the final product.

EXAMPLE 12

Preparation of Diethylene Glycol Ethyl Ether Ester of n-Octanoic Acid by Direct Esterefication A 5 liter reaction flask equipped with a mechanical stirrer, thermometer, addition funnel and a Dean-Stark distillation adapter was charged with 1600 ml of diethylene glycol monoethyl ether, 1260 ml of octanoic acid, 600 ml of n-octane and 79.6 grams of commercial Amberlist catalyst resin (polystyrene sulfonic acid).

The reaction mixture was refluxed to remove 1366 ml of water from the reaction, over 1.5 hours. The flask was then cooled to room temperature in a water bath, and the reaction product was then filtered to remove the catalyst resin. The reaction product was then washed twice with cold water once with 0.5 molar sodium hydroxide, then twice again with cold water. The material was then vacuum stripped at 125 mm pressure and 125 C.

The purity of the final product was determined by measuring the asponification number (by titration). Saponification number for the product was 221 mg KOH/grams, versus a theoretical of 216 mg KOH/grams.

The miscibility and solubilizing effects were determined experimentally by simple mixing experiments. These experiments involved both commercially purchased gasoline and Indolene, a synthetic "standard" used in the industry to simulate gasolines, and by mixing them with nitroparaffins, using the above mentioned solubilizing agents. The solubility experiments were set up in the following fashion.

Each experiment used the same size of test tube (13*100 mm). To each test tube, 5 cc of either gasoline or indolene were added. The gasoline was purchased from Texaco, lowest grade, no lead. Indolene was used as received from Magnum Environmental Technologies. The Mobil Jet II Oil was also used as received from Magnum Environmental Technologies.

To the gasoline or Indolene containing test tubes, 1 cc of nitromethane and either 0.2 cc toluene (Tables 14 and 15), or no toluene (Tables 16 and 17) were added. Both the nitromethane and toluene were as received from Aldrich Chemical. After these additions were made, each test tube was inverted three times to insure proper mixing.

After mixing, each test tube exhibited two phases of liquid, indicating non-solubility.

A specific solubilizing agent was added, by drops, to each test tube. After each drop of solubilizing agent, the test tube was inverted three times, and allowed to stand and come to equilibrium for fifteen minutes. The solubilizing agent additions were continued until the phase separation disappeared, thus a complete solution occurred. Looking at the results of Table 14, therefore, it means that it required 21 drops of PPL solubilizing agent 272-60 to solubilize the mixture, 26 drops of PPL solubilizing agent 305-35 and 39 drops of the Mobil Jet II Oil.

TABLE 14

SOLUBILITY EXPERIMENTS GASOLINE

| Example # | PPL# | Acid | Alcohol | Gasoline cc | Toluene cc | Nitromethane cc | # Drops* |
|---|---|---|---|---|---|---|---|
| 1 | 272-60 | C8 | carbitol | 5 | 0.2 | 1 | 21 |
| 2 | 305-18 | C6 | carbitol | 5 | 0.2 | 1 | 22 |
| 3 | 305-17 | C6 | cellosolve | 5 | 0.2 | 1 | 21 |
| 4 | 305-19 | C8 | cellosolve | 5 | 0.2 | 1 | 23 |
| 5 | 305-24 | Mix C6-C8 | cellosolve | 5 | 0.2 | 1 | 20 |
| 6 | 305-20 | Mix C6-C8 | carbitol | 5 | 0.2 | 1 | 20 |
| 7 | 305-35 | C8 | carbitol | 5 | 0.2 | 1 | 26 |
| Mobil Jet Oil | | — | — | 5 | 0.2 | 1 | 39 |

TABLE 15

SOLUBILITY EXPERIMENTS INDOLENE

| Example # | PPL# | Acid | Alcohol | Gasoline cc | Toluene cc | Nitromethane cc | # Drops* |
|---|---|---|---|---|---|---|---|
| 1 | 272-60 | C8 | carbitol | 5 | 0.2 | 1 | 22 |
| 2 | 305-18 | C6 | carbitol | 5 | 0.2 | 1 | 21 |
| 3 | 305-17 | C6 | cellosolve | 5 | 0.2 | 1 | 20 |
| 4 | 305-19 | C8 | cellosolve | 5 | 0.2 | 1 | 22 |
| 5 | 305-24 | Mix C6-C8 | cellosolve | 5 | 0.2 | 1 | 25 |
| 6 | 305-20 | Mix C6-C8 | carbitol | 5 | 0.2 | 1 | 19 |
| 7 | 305-35 | C8 | carbitol | 5 | 0.2 | 1 | 25 |
| Mobil Jet Oil | | — | — | 5 | 0.2 | 1 | 36 |

TABLE 16

SOLUBILITY EXPERIMENTS GASOLINE

| Example # | PPL# | Acid | Alcohol | Gasoline cc | Toluene cc | Nitromethane cc | # Drops* |
|---|---|---|---|---|---|---|---|
| 1 | 272-60 | C8 | carbitol | 5 | 0 | 1 | 14 |
| 2 | 305-18 | C6 | carbitol | 5 | 0 | 1 | 14 |
| 3 | 305-17 | C6 | cellosolve | 5 | 0 | 1 | 15 |
| 4 | 305-19 | C8 | cellosolve | 5 | 0 | 1 | 14 |
| 5 | 305-24 | Mix C6-C8 | cellosolve | 5 | 0 | 1 | 14 |
| 6 | 305-20 | Mix C6-C8 | carbitol | 5 | 0 | 1 | 14 |
| 7 | 305-35 | C8 | carbitol | 5 | 0 | 1 | 14 |
| Mobil Jet Oil | | — | — | 5 | 0 | 1 | 18 |

TABLE 17

SOLUBILITY EXPERIMENTS INDOLENE

| Example # | PPL# | Acid | Alcohol | Gasoline cc | Toluene cc | Nitromethane cc | # Drops* |
|---|---|---|---|---|---|---|---|
| 1 | 272-60 | C8 | carbitol | 5 | 0 | 1 | 11 |
| 2 | 305-18 | C6 | carbitol | 5 | 0 | 1 | 10 |
| 3 | 305-17 | C6 | cellosolve | 5 | 0 | 1 | 11 |
| 4 | 305-19 | C8 | cellosolve | 5 | 0 | 1 | 11 |
| 5 | 305-24 | Mix C6-C8 | cellosolve | 5 | 0 | 1 | 10 |
| 6 | 305-20 | Mix C6-C8 | carbitol | 5 | 0 | 1 | 11 |
| 7 | 305-35 | C8 | carbitol | 5 | 0 | 1 | 11 |
| Mobil Jet Oil | | — | — | 5 | 0 | 1 | 16 |

The present inventors have developed a new method of creating a stable mixture of nitroparaffins in gasoline and/or diesel fuel, namely by introduction of a solubilizing agent, wherein the solubilizing agent comprises at least one chemically polar end and at least one chemically non-polar end, and a mixing procedure of the present invention. The present inventors have discovered that low concentrations of fuel additives reduce emissions. Toxicity has been reduced by eliminating, modifying and/or replacing components and by reducing the concentration of additive in the fuel, while reducing emissions.

It will be apparent to those skilled in the art that various modifications and variations can be made in the construction and configuration of the present invention without departing from the scope or spirit of the invention. Thus, it is intended that the present invention cover the modifications and variations of the invention provided they come within the scope of the appended claims and their equivalents.

We claim:

1. An additive formulation for a fuel comprising:

a nitroparaffin;

a solubilizing agent comprising relatively polar and relatively non-polar ends comprising an ester compound, a simple ester compound, an ester alcohol, a simple ester alcohol, an ester ether alcohol, a simple ester ether alcohol, amino alkane compound, and an ester amine; and an aromatic hydrocarbon;

said fuel resulting in reduced emissions relative to a fuel not containing said additive.

2. The formulation of claim 1, wherein said solubilizing agent comprises at least one chemically relatively polar and at least one chemically relatively non-polar end.

3. The formulation of claim 1, wherein said solubilizing agent comprises: an ester, ester alcohol, simple ester alcohol, ester ether alcohol, simple ester ether alcohol, amino alkane or ester amine.

4. The formulation of claim 1, wherein said nitroparaffin comprises:

1-nitropropane, 2-nitropropane, nitroethane, nitromethane, or a mixture thereof.

5. The formulation of claim 1, wherein said aromatic hydrocarbon comprises an aliphatic derivative of benzene.

6. The formulation of claim 1, wherein said aromatic hydrocarbon comprises: benzene, ethyl benzene, xylene, or toluene.

7. An additive formulation for a fuel comprising:

a first component, comprising about 0 to 99 volume percent of: 1-nitropropane, 2-nitropropane, nitroethane, nitromethane, or a mixture thereof;

a second component, comprising substantially the balance of the additive formulation, of: ester alcohol, simple ester alcohol, ester ether alcohol, ester amine, or a mixture thereof; and an aromatic hydrocarbon;

the additive formulation for reducing one or more emissions selected from the group consisting of: total hydrocarbons, non-methane hydrocarbons, carbon monoxide, $NO_x$, and ozone precursors.

8. The formulation of claim 7, wherein said first component comprises:

20 to 40 volume percent nitromethane, and 60 to 80 volume percent of: 1-nitropropane, 2-nitropropane, nitroethane, or a mixture thereof.

9. The formulation of claim 7, further comprising less than 20 volume percent of an aromatic hydrocarbon and less than 10 volume percent of said second component.

10. The formulation or fuel of claim 7, wherein said formulation is adapted for use in a power unit comprising: a boiler, turbine, or internal combustion engine.

11. The formulation or fuel of claim 10, wherein said internal combustion engine comprises: a gasoline engine or a diesel engine.

12. The formulation of claim 1, wherein said reduced emissions comprise: carbon monoxide, $NO_x$, total hydrocarbon, non-methane hydrocarbon, ozone precursors, or a mixture thereof.

13. The formulation of claim 1, wherein said solubilizing agent comprises less than about 2 volume percent of said additive formulation for reducing: exhaust emissions, hydrocarbon emissions, or a mixture thereof.

14. The formulation of claim 1, wherein said nitroparaffin comprises less than about 10 volume percent of said formulation.

15. A fuel for reducing emissions from a motor vehicle, comprising:

an additive formulation comprising:

a nitroparaffin;

a solubilizing agent comprising: relatively polar and relatively non-polar ends selected from the group consisting of an ester compound, a simple ester compound; and an aromatic hydrocarbon;

said fuel resulting in reduced emissions relative to a motor fuel not comprising said additive formulation.

16. The fuel of claim 15, wherein said solubilizing agent comprises an ester, simple ester, ester alcohol, simple ester alcohol, ester ether alcohol, simple ester ether alcohol, amino alkane, ester amine, or mixture thereof.

17. The fuel of claim 15, wherein said solubilizing agent comprises: an ester alcohol, simple ester alcohol, ester ether alcohol, ester amine, or a mixture thereof.

18. The fuel of claim 15, wherein said nitroparaffin further comprises: a 1-nitropropane, 2-nitropropane, nitroethane, nitromethane, or a mixture thereof.

19. The fuel of claim 15, wherein said aromatic hydrocarbon comprises an aliphatic derivative of benzene.

20. The fuel of claim 15, wherein said aromatic hydrocarbon comprises: benzene, ethyl benzene, xylene, toluene, or a mixture thereof.

21. A fuel for reducing emissions from a motor vehicle, comprising:

an additive formulation comprising:

a first component, comprising about 0 to 99 volume percent of 1-nitropropane, 2-nitropropane, nitroethane, nitromethane, or a mixture thereof;

a second component, comprising the balance of the additive formulation, of: an ester alcohol, simple ester, ester ether alcohol, ester amine, or a mixture thereof;

said additive formulation added to said fuel to a final concentration of less than about 5 volume percent of said additive in said fuel; and said additive formulation for reducing one or more of the emissions comprising: total hydrocarbons, non-methane hydrocarbons, carbon monoxide, $NO_x$, or ozone precursors.

22. The fuel of claim 21, wherein said first component further comprises:

20 to 40 volume percent nitromethane, and 60 to 80 volume percent of: 1-nitropropane, 2-nitropropane, nitroethane, or a mixture thereof.

23. The fuel of claim 21, further comprising an additive comprising toluene.

24. The fuel of claim 21, further comprising an additive comprising less than 20 volume percent toluene and less than 10 volume percent of said second component.

25. The fuel of claim 15, wherein said additive formulation is adapted for use in a power unit comprising: a boiler, turbine, or internal combustion engine.

26. The fuel of claim 25, wherein said internal combustion engine comprises: a gasoline engine or a diesel engine.

27. The fuel of claim 15, wherein said reduced emissions comprise: carbon monoxide, $NO_x$, total hydrocarbon, non-methane hydrocarbon, ozone precursors, or a mixture thereof.

28. The fuel of claim 15, wherein said solubilizing agent comprises less than about 2 volume percent of said additive formulation to reduce emissions comprising: exhaust emissions, hydrocarbon emissions, or a mixture thereof.

29. The fuel of claim 15, wherein said nitroparaffin comprises less than about 10 volume percent of said formulation.

30. An additive formulation for motor fuels comprising:

a nitroparaffin substantially free from 2-nitropropane; and a solubilizing agent comprising less than about 10% of the final volume of said additive formulation;

wherein said solubilizing agent is: an ester compound, a simple ester compound, ester alcohol, simple ester alcohol, ester ether alcohol, simple ester ether alcohol, an amino alkane compound or ester amine comprising at least one chemically relatively polar end and at least one chemically relatively non-polar end;

said fuel resulting in reduced emissions relative to motor fuel not containing said additive.

31. The formulation of claim 30, wherein said nitroparaffin comprises: 1-nitropropane, nitroethane, nitromethane, or a mixture thereof.

32. An additive formulation for motor fuels comprising:

a first component, comprising about 0 to 99 volume percent of 1-nitropropane, nitroethane, nitromethane, or a mixture thereof;

a second component, comprising substantially the balance of the additive formulation, comprising a solubilizing agent comprising at least one chemically relatively polar end and at least one chemically relatively non-polar end;

said additive added to said fuel to a final concentration of less than about 5 volume percent of said additive in said fuel; and the additive formulation reducing emissions comprising: total hydrocarbons, non-methane hydrocarbons, carbon monoxide, $NO_x$, ozone precursors, or a mixture thereof.

33. The formulation of claim 32, wherein said first component comprises:

20 to 40 volume percent nitromethane, and 60 to 80 volume percent of one or more nitroparaffin components, comprising: 1-nitropropane, nitroethane, or a mixture thereof.

34. The formulation of claim 32, further comprising less than 20 volume percent of an aromatic hydrocarbon and less than 10 volume percent said solubilizing agent.

35. An additive formulation for motor fuels comprising:

from about 10 to about 30 volume percent nitromethane;

from about 10 to about 30 volume percent nitroethane;

from about 40 to about 60 volume percent 1-nitropropane;

from about 2 to about 8 volume percent toluene; and from about 0.5 to about 3 volume percent solubilizing agent, wherein said solubilizing agent comprises at least one chemically relatively polar end and at least one chemically relatively non-polar end.

36. The formulation of claim 35, further comprising:

about 20 volume percent nitromethane, about 20 volume percent nitroethane, and about 60 volume percent 1-nitropropane.

37. The formulation of claim 35, further comprising about 10 volume percent toluene and about 2 volume percent of said solubilizing agent.

38. The additive formulation of claim 30, further comprising an aromatic hydrocarbon.

39. The formulation of claim 30, further comprising an aliphatic derivative of benzene.

40. The formulation of claim 38, wherein said aromatic hydrocarbon comprises: benzene, ethyl benzene, xylene, toluene, or a mixture thereof.

41. The formulation of claim 30, wherein said formulation is adapted for use in a power unit comprising: boiler, turbine, or internal combustion engine.

42. The formulation of claim 30, wherein said at least one chemically relatively polar end comprises: an ether group and/or an amine group.

43. The formulation of claim 30, wherein said at least one chemically relatively non-polar end comprises: a hydrocarbon group, an aromatic hydrocarbon group, or an aliphatic hydrocarbon group.

44. The formulation of claim 30, wherein said solubilizing agent comprises: an ester, an ester alcohol, a simple ester alcohol, a simple ether alcohol ester, an ether, or an ester amine compound.

45. The formulation of claim 44, wherein said ester is prepared by the reaction of an ether alcohol with a monobasic acid.

46. The formulation of claim 44, wherein said ester is prepared by the reaction of an ether alcohol, an acid chloride, and an amine.

47. The formulation of claim 30, wherein said solubilizing agent is an amino alkane compound.

48. The formulation of claim 30, wherein said solubilizing agent is an amino alkane compound of the formula:

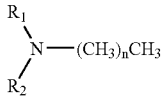

wherein $R_1$ is selected from the group consisting of: hydrogen, an alkyl group, and an aryl group;

wherein $R_2$ is selected from the group consisting of: hydrogen, an alkyl group, and an aryl group; and wherein n equals from one to eight.

49. The formulation of claim 30 wherein said reduced emissions comprise of: carbon monoxide, $NO_x$, total hydrocarbon, non-methane hydrocarbon, or ozone precursors.

50. The formulation of claim 30, wherein said solubilizing agent comprises less than about 2 volume percent of said additive formulation to reduce: exhaust emissions, hydrocarbon emissions, or a mixture thereof.

51. The formulation of claim 30, wherein said nitroparaffin comprises less than about 10 volume percent of said additive formulation.

52. A method of preparing a fuel additive formulation, comprising:

in a mixing vessel;

adding about 1 part solubilizing agent comprising at least one chemically relatively polar end and at least one chemically relatively non-polar end, selected from the group consisting of: an ester compound, and a simple ester compound;

allowing said solubilizing agent to stand for 10 minutes at ambient temperature and pressure;

adding about 10 parts nitromethane to said solubilizing agent mixture;

adding about 10 parts nitroethane to said mixture;

adding about 29 parts 1-nitropropane to said mixture;

aerating said mixture gently, through a narrow gauge tube at low pressure and ambient temperature; and storing the additive.

53. The method of claim 52, further comprising adding about 5 parts toluene, prior to the step of allowing said solubilizing agent to stand.

54. The additive made by the method of claim 52.

55. A motor fuel, comprising an additive made by the method of claim 52.

56. A motor fuel, comprising an additive made by the method of claim 52, at a concentration of about 0.1 oz. of additive per gallon of motor fuel.

57. A fuel for vehicles, comprising an additive made by the method of claim 52.

58. A fuel for reducing emissions from a vehicle, comprising:

formulating an additive comprising:

nitroparaffin substantially free from 2-nitropropane; and solubilizing agent at a concentration of less than about 10% in said additive, wherein said solubilizing agent comprises at least one chemically relatively polar end and at least one chemically relatively non-polar end; and adding said additive to said fuel at a concentration of about 1-99 volume percent of said additive to said fuel.

59. The fuel of claim 58, wherein said nitroparaffin further comprises: 1-nitropropane, nitroethane, nitromethane, or mixture thereof.

60. A fuel for reducing emissions from a motor vehicle, comprising:

formulating an additive comprising:

a first component, comprising about 0 to 99 volume percent of 1-nitropropane, nitroethane, nitromethane, or a mixture thereof;

a second component, comprising substantially the balance of the additive formulation, comprising at least one chemically relatively polar end comprising an ether group, and an amine group, and at least one chemically relatively non-polar end;

said additive added to said fuel to a final concentration of less than about 5 volume percent of said additive in said fuel; and the additive formulation reducing one or more emissions of: total hydrocarbons, non-methane hydrocarbons, carbon monoxide, $NO_x$, and ozone precursors.

61. The fuel of claim 60, wherein said first component further comprises:

20 to 40 volume percent nitromethane, and 60 to 80 volume percent of 1-nitropropane, nitroethane, or a mixture thereof.

62. The fuel of claim 60, further comprising an additive comprising less than 20 volume percent toluene and less than 10 volume percent said solubilizing agent.

63. A fuel for reducing emissions from an automobile, comprising:

formulating an additive comprising:

from about 10 to about 30 volume percent nitromethane;

from about 10 to about 30 volume percent nitroethane;

from about 40 to about 60 volume percent 1-nitropropane;

from about 2 to about 8 volume percent toluene;

from about 1 to about 3 volume percent solubilizing agent, wherein said solubilizing agent comprises at least one chemically relatively polar end selected from the group consisting of: an ether group and an amine group, and at least one chemically relatively non-polar end; and adding said additive to the fuel.

64. The fuel of claim 63, further comprising:

about 20 volume percent nitromethane, about 20 volume percent nitroethane, and about 60 volume percent 1-nitropropane.

65. The fuel of claim 63, further comprising about 10 volume percent toluene and about 2 volume percent of said solubilizing agent.

66. The fuel of claim 58, further comprising an aromatic hydrocarbon.

67. The fuel of claim 58, further comprising an aliphatic derivative of benzene.

68. The fuel of claim 66, wherein said aromatic hydrocarbon comprises: benzene, ethyl benzene, xylene, or toluene.

69. The fuel of claim 58, wherein said formulation is adapted for use in a power unit comprising: boiler, turbine, or internal combustion engine.

70. The fuel of claim 58, wherein said at least one chemically relatively polar end comprises: an ether group and an amine group.

71. The fuel of claim 58, wherein said at least one chemically relatively non-polar end comprises: a hydrocarbon group, an aromatic hydrocarbon group, or an aliphatic hydrocarbon group.

72. The fuel of claim 58, wherein said solubilizing agent comprises: an ester alcohol, a simple ester alcohol, a simple ester ether alcohol, an ester amine compound, or a mixture thereof.

73. The fuel of claim 72, wherein said ester is prepared by the reaction of an ether alcohol with a monobasic acid.

74. The fuel of claim 72, wherein said ester is prepared by the reaction of an ether alcohol, an acid chloride, and an amine.

75. The fuel of claim 58, wherein said solubilizing agent is an amino alkane compound.

76. The fuel of claim 58, wherein said solubilizing agent is an amino alkane compound of the formula:

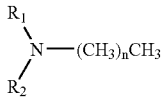

wherein $R_1$ is selected from the group consisting of: hydrogen, an alkyl group, and an aryl group;

wherein $R_2$ is selected from the group consisting of: hydrogen, an alkyl group, and an aryl group; and wherein n equals from one to eight.

77. The fuel of claim 69, wherein said internal combustion engine is selected from the group consisting of: a gasoline engine and a diesel engine.

78. The fuel of claim 58, wherein said reduced emissions comprise: carbon monoxide, $NO_x$, total hydrocarbon, non-methane hydrocarbon, ozone precursors, or a mixture thereof.

79. The formulation of claim 58, wherein said solubilizing agent comprises less than about 2 volume percent of said additive formulation to reduce: exhaust emissions and/or hydrocarbon emissions.

80. The formulation of claim 58, wherein said nitroparaffin comprises less than about 10 volume percent of said formulation.

81. The formulation of claim 1 wherein said chemically polar end comprises an ether group, an ester group or an amino group.

82. The formulation of claim 1 wherein said chemically nonpolar end comprises a hydrocarbon group.

83. The formulation of claim 30 wherein said solubilizing agent comprises an ester compound, simple ester compound, ester alcohol, simple ester alcohol, ester ether alcohol, simple ester ether alcohol, amino alkane compound, ester amine, or a mixture thereof.

84. The method of claim 52 wherein said solubilizing agent comprises: an ester compound, simple ester compound, ester alcohol, simple ester alcohol, ester ether alcohol, simple ester ether alcohol, amino alkane compound, ester amine, or a mixture thereof.

85. The fuel for reducing emissions from a vehicle according to claim 58, wherein said solubilizing agent comprises: an ester compound, simple ester compound, ester alcohol, simple ester alcohol, ester ether alcohol, simple ester ether alcohol, amino alkane compound, ester amine, or a mixture thereof.

* * * * *